US010111535B2

(12) United States Patent
Coffield

(10) Patent No.: US 10,111,535 B2
(45) Date of Patent: Oct. 30, 2018

(54) EDGE STRUCTURE FOR BODY SUPPORT SURFACE

(71) Applicant: Dahti, Inc., Grand Rapids, MI (US)

(72) Inventor: Timothy P. Coffield, Grand Rapids, MI (US)

(73) Assignee: DAHTI, INC., Grand Rapids, MI (US)

( * ) Notice: Subject to any disclaimer, the term of this patent is extended or adjusted under 35 U.S.C. 154(b) by 0 days.

(21) Appl. No.: 14/803,533

(22) Filed: Jul. 20, 2015

(65) Prior Publication Data

US 2016/0081477 A1 Mar. 24, 2016

Related U.S. Application Data

(60) Provisional application No. 62/053,337, filed on Sep. 22, 2014.

(51) Int. Cl.

| | |
|---|---|
| ***A47C 31/02*** | (2006.01) |
| ***A47C 7/28*** | (2006.01) |
| ***A47C 7/40*** | (2006.01) |
| ***A47C 7/54*** | (2006.01) |

(52) U.S. Cl.

CPC ..... *A47C 31/023* (2013.01); *A47C 7/282* (2013.01); *A47C 7/40* (2013.01); *A47C 7/54* (2013.01)

(58) Field of Classification Search

CPC ..... A47C 31/023; A47C 7/282; A47C 7/40; A47C 7/54

See application file for complete search history.

(56) References Cited

U.S. PATENT DOCUMENTS

| | | | | |
|---|---|---|---|---|
| 6,254,190 | B1 * | 7/2001 | Gregory | A47C 5/06 297/440.11 |
| 6,942,300 | B2 * | 9/2005 | Numa | A47C 7/282 297/218.3 |
| 8,251,454 | B2 * | 8/2012 | Tsukiji | A47C 7/282 297/219.1 |
| 8,465,007 | B2 * | 6/2013 | Coffield | A47C 7/282 267/142 |
| 8,616,655 | B2 * | 12/2013 | Jung | A47C 7/282 297/452.56 |
| 9,462,891 | B2 * | 10/2016 | Kikuchi | A47C 31/02 |
| 2009/0261644 | A1 * | 10/2009 | Piretti | A47C 7/282 297/344.12 |

* cited by examiner

*Primary Examiner* — Philip F Gabler

(74) *Attorney, Agent, or Firm* — Warner Norcross + Judd LLP

(57) ABSTRACT

An edge structure for a body support surface configured to provide generally rigid support for a suspension component, such as a load bearing fabric, while being flexible in response to a direct load, such as an occupant sitting directly on the edge structure. The edge structure is configured to have a substantially greater moment of inertia in the direction of loads applied by the suspension component than in the direction of direct loads. In one embodiment, the edge structure includes an arrangement of main beams and segmented beams. In another embodiment, the edge structure may include a beam with flex grooves. The flex grooves may be filled with a resilient material. In another aspect, the edge structure may include separate sections molded directly to the suspension component. The sections may be rotated and joined to form a peripheral edge structure. Rotation may place the suspension component under tension.

12 Claims, 14 Drawing Sheets

EDGE STRUCTURE FOR BODY SUPPORT SURFACE

BACKGROUND OF THE INVENTION

The present invention relates to body support surfaces and more particularly to edge structures for body support surfaces.

Suspension components, such as load bearing fabrics and molded elastomeric structures, are in wide spread use in seating and other body support applications. In some applications, the suspension components include elastomeric elements that allow the suspension component to resiliently flex under load. For example, a wide variety of seating products are commercially available that include an elastomeric load bearing fabric seat and/or back. Many of these elastomeric load bearing fabrics include elastomeric strands or filaments running in one direction and non-elastic fill yarns running in the opposite direction. In addition to load bearing fabrics, some seats include molded load bearing surfaces. Molded load bearing surface may include a wide range of surfaces that include one or more molded components that are configured to provide resilient support. For example, a molded load bearing surface may include a single sheet or film of molded material or a composite of different sheets or films of molded material. As another example, the molded load bearing surface may be include a plurality of separately manufactured components that are joined together in a manner that provides some resiliency.

One of the most important and complex aspects of a body support surface that incorporates a suspension component is the structure for joining the suspension component to the underlying support structure. In a typical application, a suspension component is supported by an underlying support structure that is configured to support the suspension component from its peripheral edges. The support structure is typically shaped so that it does not interfere with movement of the suspension component as it flexes under load. The tension in the suspension component and/or the weight of an occupant positioned on the suspension component can generate high loads. It can be particularly difficult to handle these loads when the suspension component is a load bearing fabric in which the individual strands of the fabric are susceptible to separation or damage. In many applications, the suspension component includes a carrier that allows the suspension component to be joined to the underlying support structure. For example, in seating applications, many load bearing fabric constructions include a carrier that is molded or otherwise joined to the periphery of the load bearing fabric. In most applications, the carrier is not rigid enough to support the load bearing fabric under load. In such applications, the carrier relies on structural support from the underlying support structure to bear the load. In other applications, the carrier may have sufficient strength to support the load bearing fabric. Regardless of whether the body support surface includes a rigid carrier or an underlying rigid support structure, the body support surface in a conventional application has a hard and inflexible edge. As a result, the body support surface can be uncomfortable when an occupant directly engages the hard edge.

SUMMARY OF THE INVENTION

The present invention provides an edge structure for a body support surface, such as a seat, a back or the armrests of a chair. The edge structure is configured to provide generally rigid support for a suspension component, such as a load bearing fabric, while being flexible in response to a direct load, such as an occupant sitting directly on the edge structure. As a result, the edge structure is capable of providing a relatively "soft" edge to a body support surface having a suspension component.

In one embodiment, the edge structure is configured to bend more easily in one direction than the other. More specifically, in this embodiment, the moment of inertia of the edge structure in the direction of force applied by the suspension component is substantially greater than the moment of inertia in the direction of force applied by a direct load. In use, the edge structure is arranged so that forces caused by the tension in the suspension component and the weight of an occupant positioned on the support component apply a force or bending moment that attempts to bend the edge structure in the direction that has the greater moment of inertia while the load of an occupant positioned directly on the edge structure applies a force or bending moment that attempts to bend the edge structure in the opposite direction. In one embodiment, the edge structure is cantilevered from a support structure and arranged at an angle from parallel to the extent of the suspension component. The angle is selected so that the load applied by the suspension component applies a bending moment in one direction and the load applied by an occupant directly engaging the edge structure applies a bending moment in the opposite direction. The angle may be relatively small so that the forces generated by the suspension component are directed largely down the length of the edge structure, thereby limited the associated bending moment on the edge structure.

In one embodiment, the edge structure includes one or more flexible main beams and one or more segmented beams. The segmented beams are spaced apart from the main beams to reinforce the main beams against bending in a direction toward the segmented beams. The segmented beams are configured so that when the edge structure bends towards the segmented beams, the segments abut one another and the associate material functions as a compression member to resist bending. When the edge structure bends away from the segmented beams, the segments are generally free to separate from one another and therefore the associated material does not function as a tension member. The segmented beams may be arranged between the main beams and the suspension component so that the segmented beams reinforce the main beams against bending in response to loads applied by the suspension component. These loads may include the loads resulting from the tension in the suspension component, as well as the loads resulting from an occupant placing weight on the suspension component.

In one embodiment, the edge structure may include an alternating arrangement of main beams and segmented beams. The main beams and segmented beams may be offset to facilitate molding using conventional molding techniques and apparatus. In one embodiment, the segmented beams are defined by a plurality of beam segments that bridge adjacent pairs of main beams. In one embodiment, each beam segment is supported on opposite sides by relatively narrow connectors that join the segments to the adjacent main beams.

If desired, the edge structure may include secondary segmented beams that reinforce the main beams in the direction of primary flex. For example, the secondary segmented beams may be positioned adjacent the main beams on the side opposite the primary segmented beams discussed above. The secondary segmented beams may define gaps between the segments so that they do not provide supplement support until the main beams have bent a sufficient distance to close the gaps. By adjusting the width of the gaps, the secondary segmented beams may be tuned to provide the edge structure with a complex response to direct loads.

As an alternative to a one-piece edge structure, the present invention may include an edge structure assembly having an edge structure with the main beams and a separately manufactured segmented beam layer with the segmented beams. The segmented beam layer may be secured to the edge structure after manufacture.

In an alternative embodiment, the edge structure defines a plurality of flex grooves that provide the beam with the desired bending profile. When the edge structure is bent toward the flex grooves, the facing surfaces of the flex grooves engage one another and the associated material functions as a compression member to resist further bending in that direction. When the edge structure is bent away from the flex grooves, the flex grooves are free to open and the associated material has a materially limited impact as a tension member. The width of the flex grooves may vary to control the bending profile of the edge structure. For example, the flex grooves may be slits that have essentially no width such that there is essentially no gap between the facing surfaces of the slits even when the beam is not flexed. As another example, the flex grooves may form gaps that provide a material amount of space between the facing surfaces. With gaps, the edge structure will bend an initial amount before the surface abut and the associated material functions to reinforce against further bending.

In some embodiments, the flex grooves may be filled with a resilient material. The resilient material may help to control the bending profile to the edge structure and to provide it with resiliency. In those embodiments in which the edge structure is capable of resiliently flexing inwardly in response to the forces generated by the suspension component, the body support structure may provide elastic support without an elastic suspension component. Instead, in such embodiments, the edge structure may be tuned to provide the system with the desired elasticity. In some applications, the suspension component may include a resilient carrier for securing the suspension component to the edge structure. In such applications, the flex grooves may be filled with fingers extending into the flex grooves from the carrier.

In another aspect, the present invention provides a body support surface in which the edge structure is molded directly in place on the suspension component. The edge structure may include a plurality of separate sections that are joined together after molding to form the body support surface. The edge structure may include four separate sections that are capable of being joined to one another at opposite ends to form a peripheral frame. In one embodiment, the edge structure sections are molded in an orientation that requires them to be rotated during assembly. This rotation may result in the suspension component being wrapped around the peripheral edge of the sections, thereby improving the look and feel of the body support surface. If desired, the sections may be formed with mating features that allow them to be readily interconnected. For example, the sections may include mating pins and recesses or they may include mating dovetail features.

The present invention provides a simple and effective flexible edge structure that allows suspension components to be joined to an underlying support structure. The edge structure is capable of providing rigid support for the suspension component while providing soft and flexible support for loads applied directly to the edge structure. The edge structure can be easily manufactured using conventional techniques and apparatus. Further, the bending profile of the edge structure can be readily tuned to the desired application by adjusting the design and configuration of the edge structure features, such as the main beams, the segmented beams, the flex grooves and/or any resilient material that may be disposed in the flex grooves.

These and other objects, advantages, and features of the invention will be more fully understood and appreciated by reference to the description of the current embodiment and the drawings.

Before certain embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

DESCRIPTION OF THE CURRENT EMBODIMENT

Overview.

Figure 1:
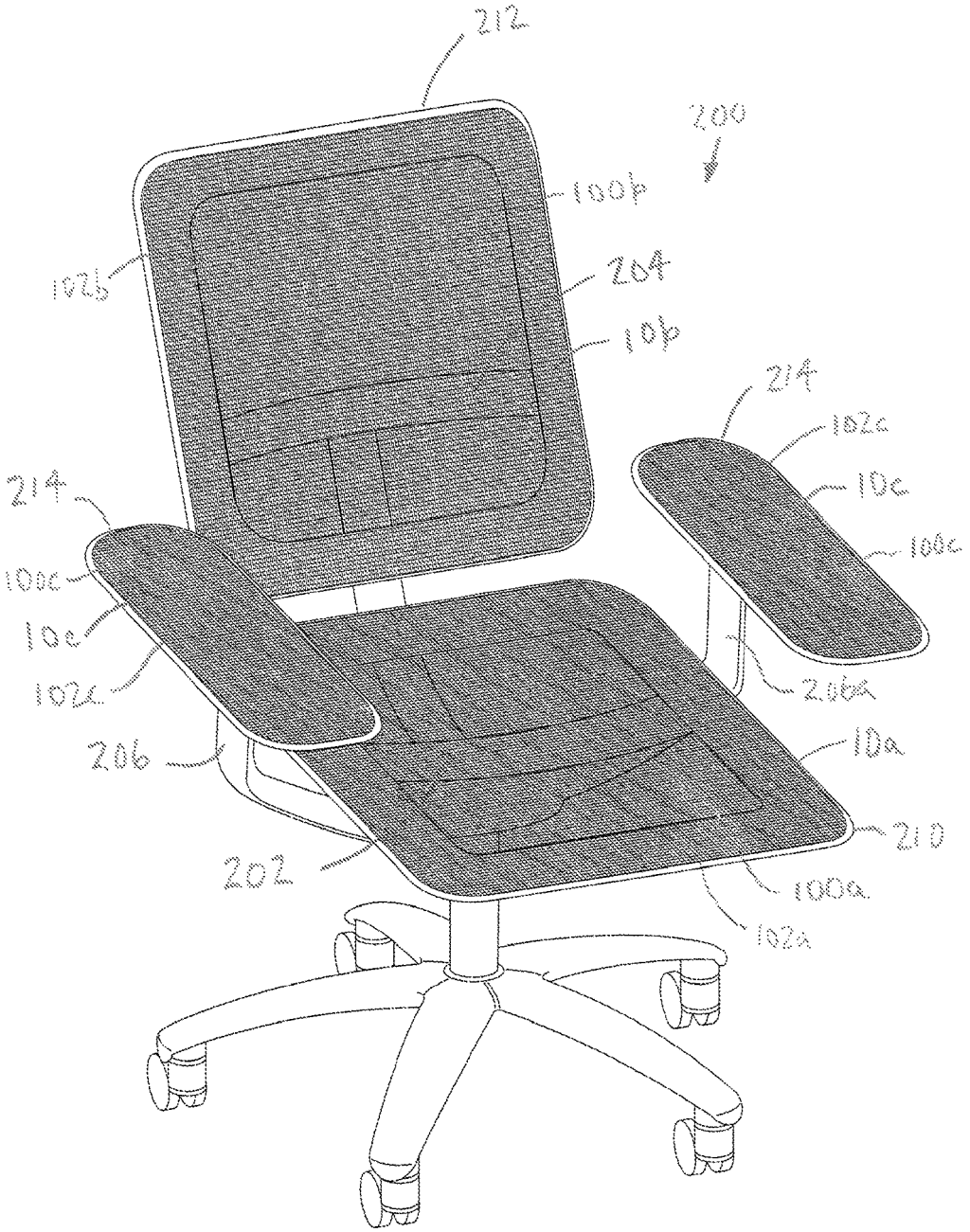
FIG. 1 is a perspective view of a chair incorporating various suspension components having edge structures in accordance with the present invention.

In a first aspect, the present invention provides an edge structure for a suspension component. The edge structure provides rigid support for a suspension component, but is flexible when subjected to direct loads. As a result, the edge structure can be used to provide a body support surface with "soft edges." For purposes of disclosure, the present invention is described primarily in the context of an office chair. A chair 200 having a plurality of edge structures 10*a-c* in accordance with an embodiment of the present invention is shown in FIG. 1. In this embodiment, the chair 200 includes three edge structures 10*a-c* that join different body support structures to the chair 200. More specifically, the chair 200 of this embodiment include a seat suspension component 110*a* that is secured to a seat frame 202 by seat edge structure 10*a*, a back suspension component 110*b* that is secured to a back frame 204 by back edge structure 10*b* and a pair of armrest suspension components 100*c* that are secured to a pair of armrest frames 206 by armrest edge structures 10*c*. In this embodiment, the edge structures 10*a-c* receive and support the peripheral edges of the corresponding suspension components 100*a-c*. The edge structures 10*a-c* are configured to provide relatively rigid support against loads applied by the suspension components 100*a-c* while at the same time providing a "soft" edge that bends when directly engaged by an occupant of the seat. To achieve this function, the various edge structures 10*a-c* are configured to have significantly greater resistance to bending in the direction of forces applied by the suspension components 110*a-c* than in the opposite direction.

Figure 4:
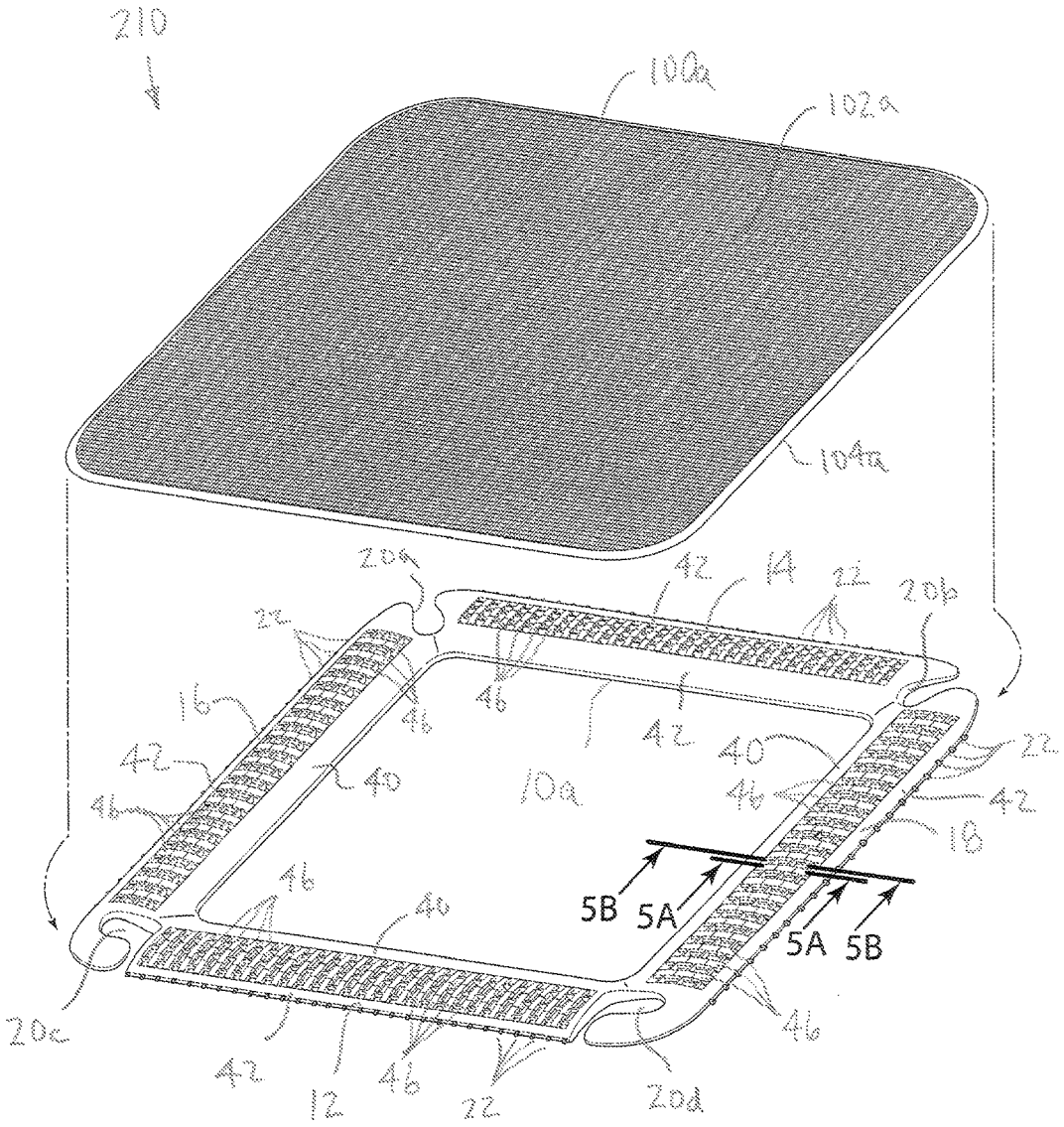
FIG. 4 is an exploded view of the seat.

In one embodiment, the edge structure 10*a-c* includes an arrangement of main beams 44 and segmented beams 46 that extend between inner and outer rails 40 and 42 (See FIG. 4). The segmented beams 46 provide the edge structures 10*a-c* with substantially different moments of inertia when subjected to bending forces in opposite directions. More specifically, the segmented beams 46 are arranged to function as compression members that reinforce the main beams 44 against bending in response to the forces applied by the suspension components 100*a-c*. At the same time, the segmentation in the segmented beams 46 effectively prevents them from functioning as tension members when the main beams 44 are subjected to bending moments in the opposite direction.

Figure 12A:
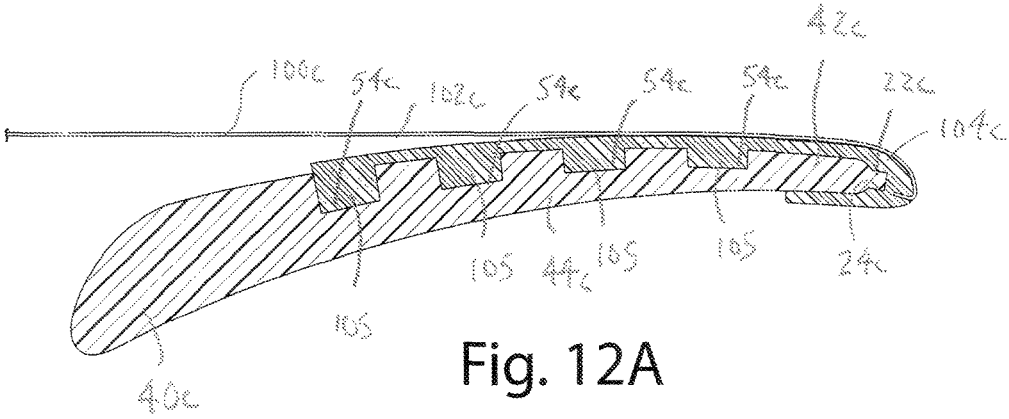
FIG. 12A is a cross section of the alternative armrest.

In alternative embodiments, the segmented beams 46 may be eliminated and the edge structure may include flex grooves, such as gaps or slits, that substantially vary the moment of inertia in opposite directions. For example, the edge structure may include a plurality of slits on the side facing the suspension component (See FIGS. 12A, 15 and 23). When subject to forces applied by the suspension component, the slits are closed and the slitted portion of the edge structure functions as a compression member. However, when subject to forces in the opposite direction, the slit open thereby effectively preventing the slitted portion of the edge structure from functioning as a tension member. The size (e.g. width, depth or length), shape and arrangement of slit or gaps can be varied to tune the bending profile of the edge structure.

The present invention is described in the context of various body support structures in an office chair, including a seat, a back and a pair of armrests. The present invention may, however, be used in connection with other body support structures, such as other forms of seating and bedding (e.g. beds, cots, etc.).

The present invention is intended for use in supporting a wide range of suspension components. This includes but is not limited to load bearing fabrics and other elastomeric structures. With regard to load bearing fabrics, the support component may be an elastomeric textile that has at least some elastic filaments or strands that help to provide the load bearing fabric with elasticity. The load bearing fabric may have a single layer or it may have multiple cooperating layers. The load bearing fabric may have a planar or non-planar configuration. Alternatively, the load bearing fabric may be manufactured entirely from non-elastic components. Non-elastic load bearing fabric may be used to provide a body support structure without elasticity or the elasticity may be provided by the edge structure as described herein. The term "fabric" is used herein in a broad sense, and is intended encompass both fabrics and textiles. As an alternative to load bearing fabric, the suspension component may be a molded structure, such as the load bearing surfaces disclosed in U.S. Pat. No. 7,441,758 to Coffield, which issued on Oct. 28, 2008, and U.S. Pat. No. 8,534,648 to Coffield, which issued on Sep. 17, 2013. The suspension component may be a single molded structure or it may be a composite structure assembled from a variety of separately formed subcomponents.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation (s).

Construction.

Figure 2:
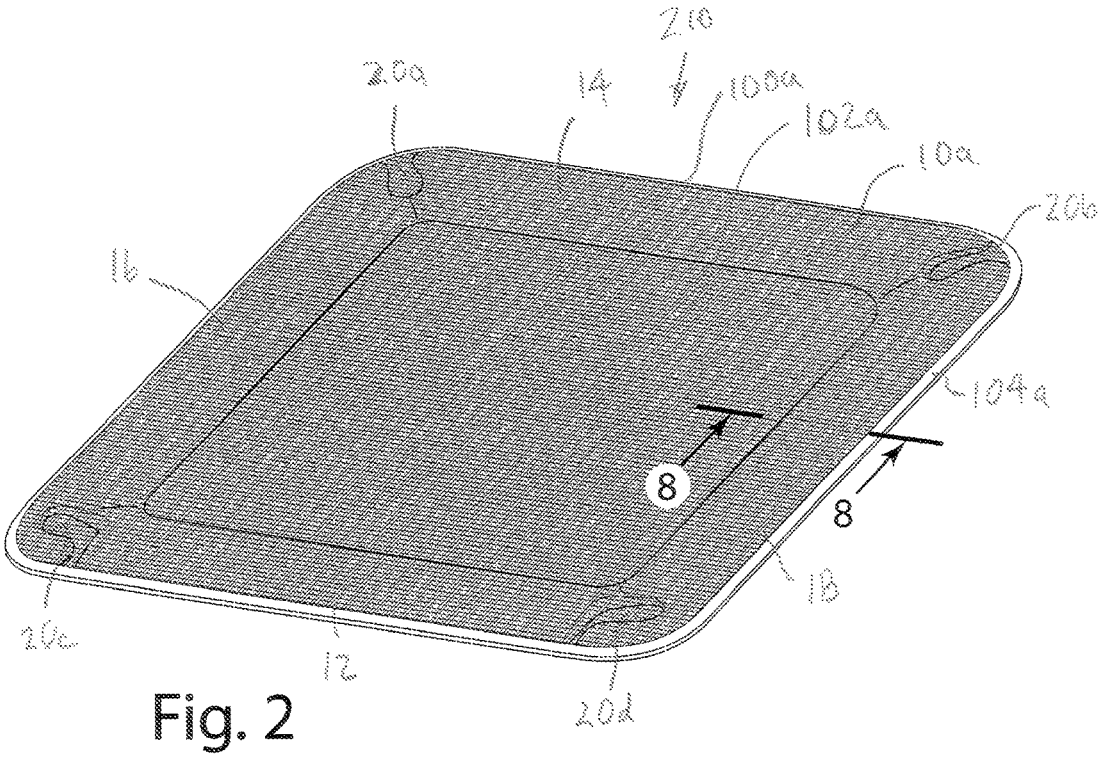
FIG. 2 is a perspective view of the seat.
Figure 3:
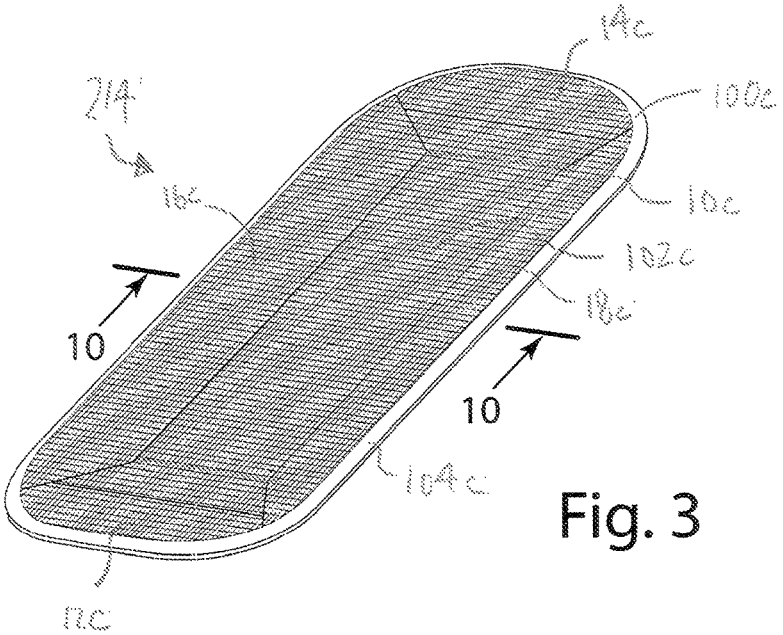
FIG. 3 is a perspective view of an armrest.

As noted above, the present invention is described primarily with reference to a chair 200 having suspension components 100*a-c* and corresponding edge structures 10*a-c* forming the seat 210, back 210 and armrests 212. To avoid clutter, FIGS. 1-3 are shown without select details in the edge structures 10*a-c*. More specifically, in FIG. 1, details of the corner reliefs 20*a-d* and beams 44 and 46 are omitted, and in FIGS. 2-3, details of the beams 44 and 46 are omitted. The omitted components are shown in the remaining drawings.

In this embodiment, a seat edge structure 10*a* (See FIG. 2) is mounted to the seat frame 202 to support the seat suspension component 100*a*, a back edge structure 10*b* is mounted to the back frame 204 to support the back suspension component 100*b* and armrest edge structures 10*c* (See FIG. 3) are mounted to the armrest frames 206 to support the armrest suspension components 100*c*. In the illustrated embodiment, the chair 200 is generally conventional, except with respect to the edge structures 10*a-c* and suspension components 100*a-c*. As a result, the chair 200 will not be described in detail. Suffice it to say that the seat frame 202 is mounted atop the pedestal 208. The pedestal 208 may be a generally conventional office chair pedestal with wheels 214 and a central upright 216. The back frame 204 may be mounted to the seat frame 202 by a back support member 210. The armrests frames may be mounted to armrest uprights 212 that are mounted to and extend from the seat frame 202 or related components. The configuration of the chair 200 may vary from application to application as desired. For example, the chair may be adapted to include a different sized, shaped or configured seat, back or armrest, or it may include a recliner mechanism (not shown). In the illustrated embodiment, the body support surfaces of the seat, back and armrests are generally planar. The edge structures 10*a-c* may be configured to give these components a non-planar shape, if desired. For example, the seat 210 may be configured to follow a gradual curve from front to rear. As another example, the back 212 may be configured to follow a curve that gives support to the lumbar region.

Except as otherwise noted, the seat edge structure 10*a* and back edge structure 10*b* are generally identical in the illustrated embodiment. Some of the primary differences between the seat edge structure 10*a* and the back edge structure 10*b* are that the dimensions of the structures 10*a* and 10*b* may vary to correspond with the size and shape of the seat 210 and the back 212, and that the seat edge structure 10*a* may be configured to support more load than the back edge structure 10*b*. For example, the seat edge structure 10*a* may be manufactured from a stronger material than the back edge structure 10*b* or it may be larger in dimension to compensate for the additional load expected on the seat. Given the general similarity between the seat edge structure 10*a* and the back edge structure 10*b*, the back edge structure 10*b* will not be described in detail. Although the armrest edge structures 10*c* are also generally similar to the seat edge structure 10*a*, a number of alternative armrest edge structures 10*c* will be described in more detail below. The alternative embodiments are described in connection with the armrests 214, but they can be incorporated into edge structures for other body support surfaces, such as the seat 210 or back 212.

As perhaps best shown in FIG. 4, the seat generally includes a seat edge structure 10*a* and a seat suspension component 100*a*. The seat suspension component 100*a* of this embodiment includes a load bearing fabric 102*a* joined along its periphery to a carrier 104*a*. In this embodiment, the carrier 104*a* provides a structure for joining the load bearing fabric 102*a* to the edge structure 10*a*. The carrier 104*a* may be joined to the fabric 102*a* in essentially any way. For example, the carrier 104*a* may be molded directly onto the fabric 102*a*, or it may be joined to the fabric 102*a* mechanically and/or by adhesive. The carrier 104*a* may be manufactured from a wide range of polymeric or elastomeric materials capable of joining to the load bearing fabric 102*a* and withstanding the anticipated loads. It may be desirable for the material of the carrier 104*a* to be sufficiently elastic to allow the carrier 104*a* to be stretched as it is fitted onto the edge structure 10*a*. For example, in the illustrated embodiment, the carrier 104 is molded from a thermoplastic material, and more specifically from a thermoplastic elastomer ("TPE"), such as Dupont® Hytrel®. In alternative embodiments, the carrier may be manufactured from a blend of TPE and poly(butylene terephthalate) ("PBT"). The blend may vary depending on the desired characteristics of the carrier 104. Although the load bearing fabric 102*a* is joined to a carrier 104*a* in this embodiment, the load bearing fabric 102*a* may be secured directly to the edge structure 10*a* without a carrier. For example, the load bearing fabric 102*a* may be secured to the edge structure 10*a* by a draw string. With this alternative, the peripheral edge of the load bearing fabric 102*a* may be wrapped over the edge structure 10*a* and it may be drawn tight by a draw string (not shown). The draw string may be disposed in a channel extending around the periphery of the load bearing fabric 102*a*.

Figure 8:
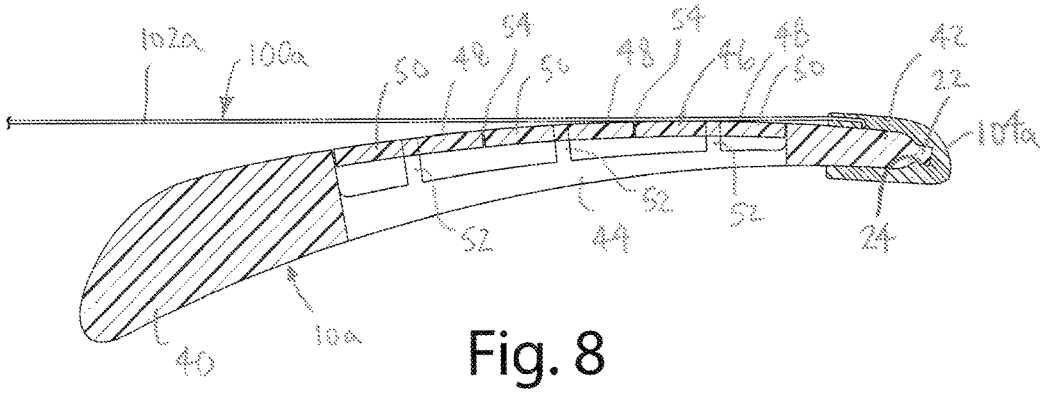
FIG. 8 is a cross section taken along line 8-8 of FIG. 2.

The carrier 104*a* may be secured to the edge structure 10*a* using any suitable attachment. In the illustrated embodiment, the carrier 104*a* is secured to the edge structure 10*a* using mechanically interfitted features. The interfitted features may vary, but in the illustrated embodiment includes a plurality of mating pins 22 and recesses 24 (See e.g. FIG. 8). In the carrier 104*s* shown in FIG. 4, a plurality of square pins 22 are spaced around the circumference of the edge structure 10*a* and extend outwardly from the outer rail 42. A plurality of corresponding square recesses 24 are defined in the inner face of the carrier 104*a*. The recesses 24 are arranged to closely interfit with the pins 22 when the carrier 104*a* is installed on the edge structure 10*a*. In one embodiment, the carrier 104*a* is stretched during assembly to allow it to be fitted over the pins 22. Although the illustrated embodiment includes pins extending from the edge structure 10*a*, the pins 22 and recesses 24 may be reversed with the pins extending from the carrier and the recesses defined in the edge structure. In one alternative embodiment (not shown), the pins/recess may extend upwardly/downwardly rather than inwardly/outwardly. This may reduce or eliminate the need for the carrier 104*a* to be stretched during assembly of the carrier 104*a* onto the edge structure 10*a*. The shape of the pins and recesses may vary from application to application as desired. In some applications, the pins and recesses may be configured to interlock. For example, each pin may include a head and the recesses may be shaped to receive the heads. If desired, the heads may have a bard-like or ratchet-like shape that allows then to be easily inserted into the recesses, but difficult to remove. As an alternative (or in addition) to pins/recesses, the carrier 104*a* may be secured to the edge structure 10*a* using fasteners, adhesive or essentially any other attachment structure.

In the illustrated embodiment, the seat edge structure 10*a* is a generally peripheral structure having four generally linear sections 12, 14, 16 and 18 that form the front, rear, left and right edges of the seat. In the illustrated embodiment, the edge structure 10*a* is a single unitary construction in which the four sections 12, 14, 16 and 18 are integrally joined at the corners. The number of sections and the manner in which they are joined may vary from application to application. For example, the edge structure may be of a single circular or oval construction. As another example, the edge structure may be hexagonal and include five sections. Although generally linear in the illustrated embodiment, the sections 12, 14, 16 and 18 need not be linear, but instead may have non-linear shape as desired. For example, the sections may be curved to support the suspension component in a curved configuration. It should also be noted that the sections need not be integrally formed. Rather, the sections may be separately formed and joined together after separate manufacture. In some applications, the edge structure may include sections that are not joined, but instead remain separate in final assembly. For example, the edge structure may include front and rear sections that are spaced apart with no right or left side sections, or vice versa. In the illustrated embodiment, all four sections of the edge structure 10*a* are configured to provide a flexible edge. In alternative embodiments, one or more sections of the edge structure may be provided without a flexible edge. For example, in the context of a seat, flexibility may be provided in the front and side sections, but the rear section may be a solid, continuous rigid structure that is not configured to flex under a direct load.

As perhaps best shown in FIG. 4, the seat edge structure 10*a* may define a corner relief 20*a*, 20*b*, 20*c* and 20*d* in each corner. Each corner relief 20*a-d* may be configured to provide some decoupling between adjacent sections 12, 14, 16 and 18 to facilitate bending of the seat edge structure 10*a* when subject to a downward load. The corner reliefs 20*a-d* may vary from application to application, and may be eliminated when not desired. For purposes of disclosure, the seat edge structure 10*a* is shown with two different types of corner reliefs. Corner reliefs 20*a-b* show a first embodiment in which each relief is defined by an outwardly opening void disposed in the center of the corresponding corner. In this embodiment, the carrier 104*a* bridges the gaps created by the corner reliefs 20*a-b* in the corners of the seat. Corner reliefs 20*c-d* show an alternative embodiment in which each relief is defined by a void that opens adjacent to, but not in, the corner. With this alternative embodiment, the carrier 104*a* bridges a gap that is not located directly in the corner. As a result, the edge structure may provide better support for the carrier 104*a* through the corners. The width, depth, position and shape of the openings in both embodiments may vary from application to application to balance the characteristics of seat edge structure 10*a* in the corners. In some applications, the corner reliefs may be eliminated. In applications where the edge structure does not include linear sections, the relief details may be incorporated as desired. For example, in the context of a circular edge structure (not shown), relief details may be provided at four radially symmetric locations about the edge structure.

Figure 5A:
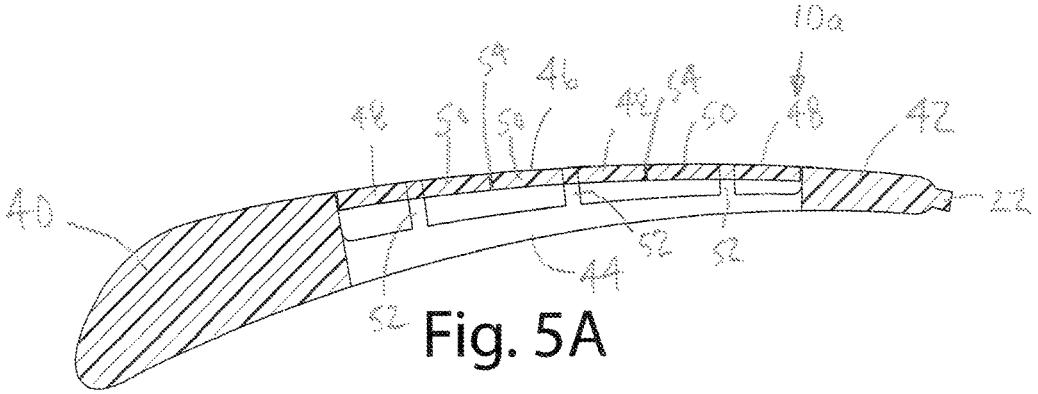
FIG. 5A is a sectional view take along line 5A-5A of FIG. 4.
Figure 5B:
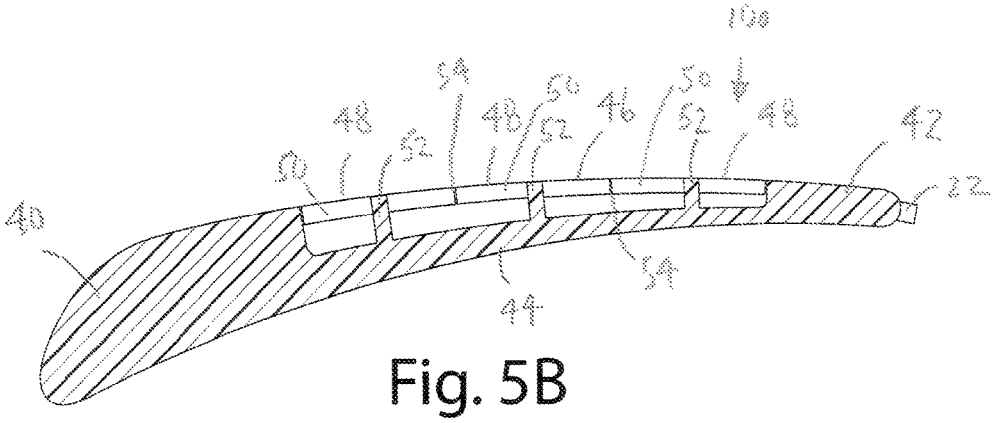
FIG. 5B is a sectional view take along line 5B-5B of FIG. 4.

As noted above, the edge structure 10*a* is configured to have materially different bending characteristics in opposite directions so that the edge structure 10*a* can provide rigid support for the seat suspension component 100*a* while being flexible in response to direct loads. This can be achieved using a variety of alternative constructions. In the embodiment shown in FIG. 4-7, the edge structure 10*a* generally includes an inner rail 40, an outer rail 42, a plurality of main beams 44 and a plurality of segmented beams 46. The inner rail 40 and outer rail 42 extend longitudinally along the length of the edge structure 10*a* to form the inner and outer peripheral edges of the edge structure 10*a*. The two rails 40 and 42 are spaced apart from one another and are joined by the main beams 44 and the segmented beams 46. The two rails 40 and 42 may be joined by generally continuous material in the corners. The main beams 44 and segmented beams 46 extend generally transverse to the longitudinal extent of the edge structure 10*a*, and collectively form a bending beam that plays a primary part in defining the bending characteristics of the edge structure 10*a*. In this embodiment, the inner rail 40 is configured to mount to the seat frame 202 with the remainder of the edge structure 10*a* cantilevered outwardly and slightly upwardly (as described in more detail below). As a result, the loads applied by the suspension component 100*a* apply an upward bending moment to the edge structure 10*a* and the loads applied by direct engagement by an occupant apply a downward bending moment to the edge structure 10*a*. As perhaps best shown in FIGS. 5A and 5B, the edge structure 10*a* may be tapered along its length to control the moment of inertia and the associated bending characteristics. The configuration of the taper may vary from application to application to tune the bending characteristics. In the illustrated embodiment, the edge structure 10*a* has a generally uniform taper from inner to outer edge. This taper may extend through the inner rail 40, the outer rail 42 and, as discussed below, through the main beams 44. It may also extend through the segmented beams 46, if desired.

Figure 6A:
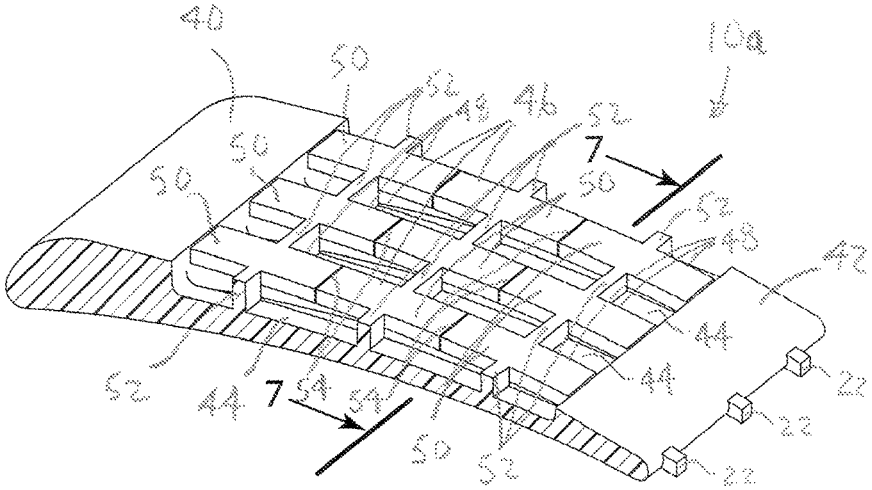
FIG. 6A is a top perspective view of a section of edge structure.
Figure 6B:
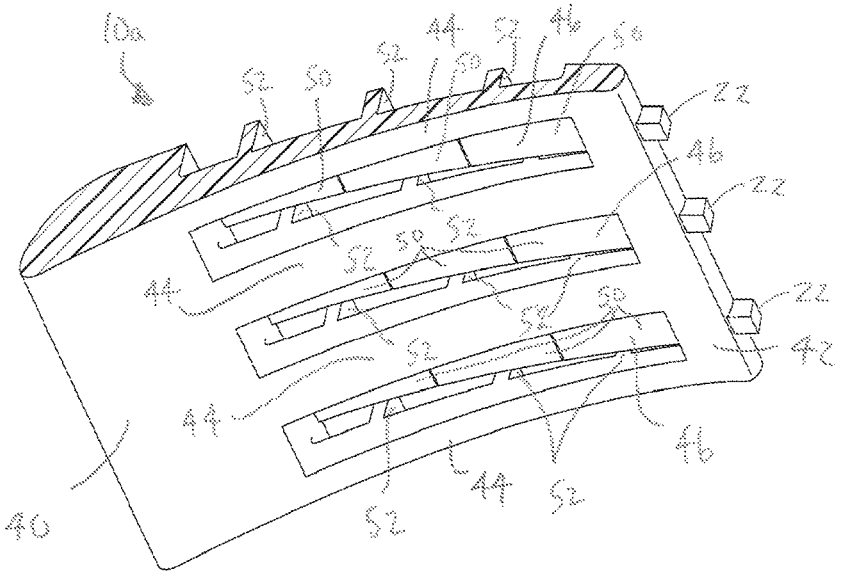
FIG. 6B is a bottom perspective view of a section of edge structure.
Figure 7:
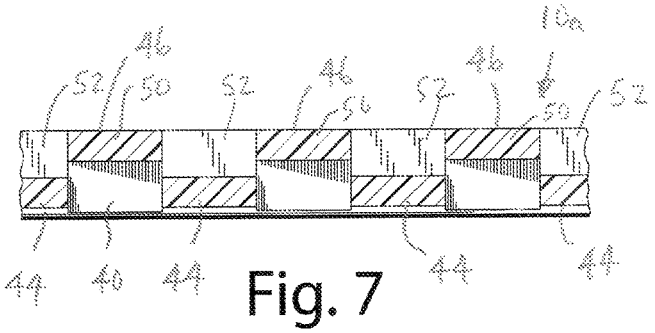
FIG. 7 is a sectional view take along line 7-7 of FIG. 6A.

In the illustrated embodiment, each section of the edge structure 10*a* includes a plurality of spaced-apart main beams 44 that are generally parallel and extend in a generally transverse direction between the inner rail 40 and outer rail 42 (See FIGS. 6B and 7). In this embodiment, the main beams 44 are the principle bending components of the edge structure 10*a* in the sense that they play a primary role when the edge structure 10*a* is bent in either the upward direction (resulting from forces applied by the load bearing fabric) or the downward direction (resulting from forces applied directly to the edge structure). In the illustrated embodiment, the segmented beams 46 materially reinforce the main beams 44 with respect to forces applied by the load bearing fabric, but play little or no role in resisting forces applied directly to the edge structure. The material and dimensions of the main beams 44 (e.g. length, height and width) may be selected to provide the edge structure 10*a* with the desired bending characteristics. As noted above, each main beam 44 may be tapered to vary the moment of inertia along the length of main beam 44, thereby controlling the lengthwise bending profile. As shown, the main beams 44 may be uniformly tapered down toward the outer end. In the illustrated embodiment, the main beams 44 taper in the vertical direction, but they could additionally or alternatively taper in the horizontal direction (or other directions). As shown, the undersurface of the main beams 44 may be continuous with the undersurface of the inner rail 40 and the outer rail 42. This is not, however, necessary. In the illustrated embodiment, the main beams 44 are integrally formed with the inner rail 40 and the outer rail 42. The various components may, however, be separately manufactured and joined after manufacture, if desired.

Figure 9:
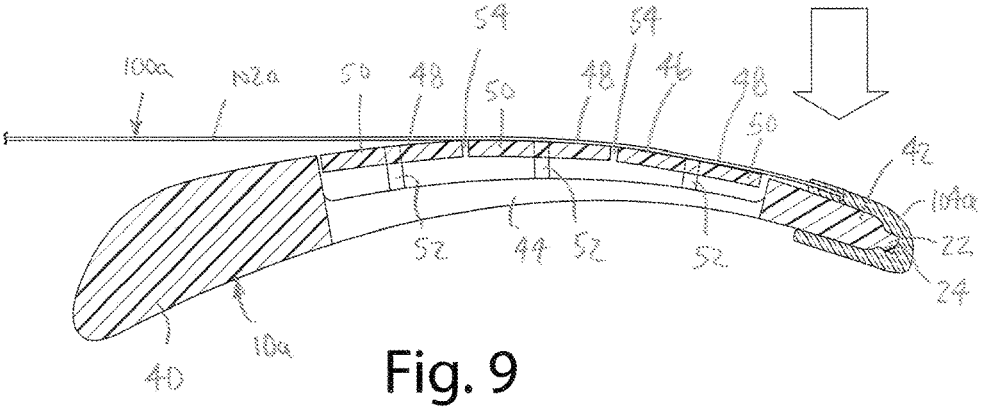
FIG. 9 is a cross section similar to that of FIG. 8, except that the edge structure is shown with a downward bend.
Figure 10:
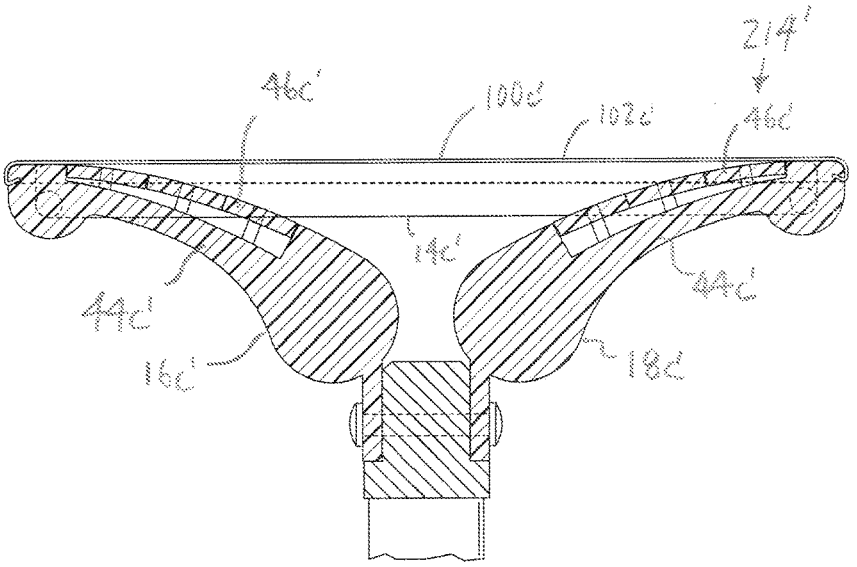
FIG. 10 is a cross section of an armrest taken along line 10-10 of FIG. 3.
Figure 13:
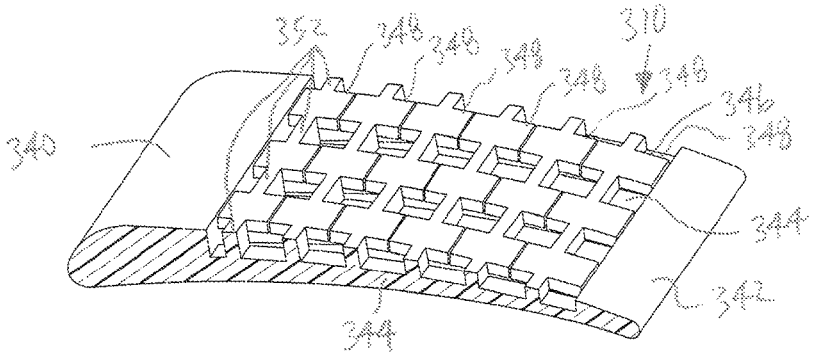
FIG. 13 is a perspective view of an alternative edge structure having a segmented beam with six segments.

As with the main beams 44, each section of edge structure 10*a* includes a plurality of spaced-apart segmented beams 46 that are generally parallel and extend in a generally transverse direction between the inner rail 40 and outer rail 42 (See FIGS. 6A and 7). In this embodiment, the segmented beams 46 are disposed over the gaps between adjacent main beams 44. In this embodiment, each segmented beams 46 is defined by a plurality of beam segments 48 that are configured so that the segmented beam 46 functions as a compression member, but not a tension member. More specifically, in use, adjacent segments 48 abut one another when the segmented beam 46 is under compression (See FIG. 8), but are largely free to separate when the segmented beam 46 is placed under tension (See FIG. 9). In the illustrated embodiment, each segmented beam 46 includes three beam segments 48 that are supported by the adjacent main beams 44. As perhaps best shown in FIG. 6A, each beam segment 48 includes a beam section 50 and a pair of connectors 52 that join the beam section 50 to the main beams 44. In the illustrated embodiment, each segmented beam 46 includes three beam segments 48, but the number of beam segments 50 may vary from application to application. For example, as shown in FIG. 13, the segmented beams 46 may include six beam segments. As another example shown in FIG. 14, the segmented beams 46 may include a single beam segment. In this embodiment, a relatively narrow gap 54 is defined between the adjacent beam segments 48 of a single segmented beam 46. The gaps 54 allow the edge structure 10*a* to bend upwardly and inwardly (i.e. toward the segmented beams 46) more freely until the gaps 54 have closed. Once the gaps 54 in a beam segment 46 have closed, the segments 50 abut one another and collectively become a compression member. This significantly increases the moment of inertia associated with further upward/inward bending of the edge structure 10*a*. The width of the gaps 54 may vary from application to application, and/or from location to location within an edge structure 10*a* to control or tune the bending characteristics of the edge structure 10*a*. For example, the gaps 54 may have no width when it is desirable to provide a greater moment of inertia from the relaxed position of the edge structure 10*a*. As another example, the gaps 54 may be wider when it is desirable to allow the edge structure 10*a* to bend upwardly and inwardly farther in response to forces applied by the load bearing fabric 102*a*.

The orientation of the edge structure 10*a* may be selected to assist in providing the edge structure 10*a* with the desired bending characteristics. In the illustrated embodiment, the edge structure 10*a* is oriented so that it is at a small angle with respect to the extent of the load bearing fabric 102*a*. In the illustrated embodiment, the angle is approximately thirty degrees, and may, in alternative applications, be in a range from about five degrees to about sixty degrees or more broadly in a range from about one degree to about eighty-five degrees. As such, the inwardly directed force applied to the edge structure 10*a* by the load bearing fabric 102*a* is directed largely along the length of the edge structure 10*a* to reduce the bending moment on the edge structure 10*a*. The orientation of the edge structure 10*a* with respect to the load bearing fabric may vary from application to application as desired. For example, the edge structure 10*a* may be oriented at a greater angle with respect to the load bearing fabric 10*a* when it is desirable for the edge structure 10*a* to provide some bending movement in response to forces applied by the load bearing fabric 102*a*. It should be understood that the edge structure 10*a* may follow a curve, such that the angle of the edge structure with respect to the suspension component 100*a* may vary along the length of the beams 44 and 46. For example, in the illustrated embodiment, the edge structure 10*a* is curved so that it becomes increasingly closer to parallel to the suspension component 100*a* toward the outer edge. The edge structure 10*a* may reach an apex and curve away from the suspension component 100*a*. For example, as perhaps best shown in FIG. 8, the outermost edge of the outer rail 42 may curve down away from the suspension component 100*a*. This may, among other things, provide improved aesthetics in some application.

As noted above, the segmented beams 46 are disposed over the gaps between the main beams 44. As a result, the main beams 44 and segmented beams 46 alternate along the length of the edge structure 10*a*, which may best be seen in FIGS. 6A and 6B. This facilitates manufacture of the edge structure 10*a* using conventional molding methods and apparatus. The edge structure 10*a* may include alternative constructions. For example, the main beams 44 and segmented beams 46 need not alternate, but instead may be aligned with one another. Or, the edge structure 10*a* may include a different number of main beams 44 and segmented beams 46. For example, the edge structure 10*a* may include two main beams 44 for each segmented beam 46. The edge structure 10*a* may be manufactured from essentially any polymeric or elastomeric material having sufficient strength, resiliency and flexibility characteristics. In some applications, it may be desirable to use a fiber-reinforced polymer. For example, the edge structure may be manufactured from a polymer having one or more reinforcing additives, such glass or carbon. In the illustrated embodiment, the seat edge structure 10*a* is molded from nylon, such as Dupont® Zytel®, or from polyester, such as Dupont® Crastin® (thermoplastic polyester resin). The edge structure may alternatively be manufactured from a blend of TPE and PBT. The ratio of TPE and PBT may vary from application to application.

Figure 14:
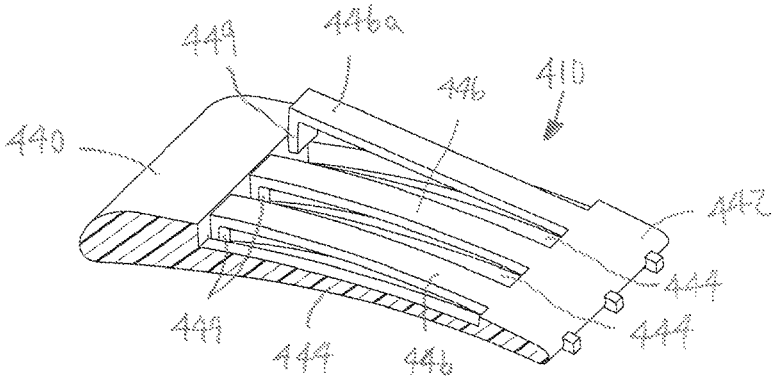
FIG. 14 is a perspective view of an alternative edge structure having a segmented beam with one segment.

In the illustrated embodiment, the edge structure 10 includes segmented beams 46 that include three segments. As noted above, the number of segments 48 may, however, vary from application to application as desired. In some applications, the number of segments may vary from segmented beam to segmented beam within the same edge structure. FIG. 13 shows an alternative edge structure 310 in which each segmented beam 346 includes six segments rather than three. In the embodiment of FIG. 13, the edge structure 310 is essentially identical to edge structure 10*a*, except that it includes a different number of segments 348. As a result, edge structure 310 will not be described in detail. Suffice it to say that edge structure 310 includes inner rail 340, outer rail 342, main beams 344 and segmented beams 346. Each segment beam 346 includes six segments 348 that in turn include a beam section 350 and a pair of connectors 352. As another example, FIG. 14 shows an alternative edge structure 410 in which the segmented beam 446 includes only one segment 348. The edge structure 410 of FIG. 14 is generally identical to edge structure 10*a*, except with respect to the configuration of the segmented beams 446. Accordingly, edge structure 410 will be described in limited detail. Edge structure 410 of FIG. 14 includes inner rail 440, outer rail 442, main beams 444 and segmented beams 446. Each segmented beam 446 includes a single segment 448 that is supported on one longitudinal end. In this illustration, the segmented beam 448 is joined to the outer rail 442, but it could alternatively be joined to the inner rail 440 or by the main beams 444. In this embodiment, the free end of the segment 448 includes a short leg 449 that extend downwardly. The leg 449 is optional, but it may help to prevent the free end of the segment 448 from catching on the top surface of the inner rail 440. For purposes of disclosure, one of the segmented beams 446*a* is shown in an upwardly bent state to illustrate how leg 449 will remain in engagement with the inner rail 440 even when the free end of segment 446*a* is bent upwardly beyond the upper surface of the inner rail 440.

As noted above, an edge structure according to an embodiment of the present invention may be incorporated into the armrests 214. For purposes of disclosure, alternative armrest constructions with alternative edge structures 10*c* and 10*c*' will be described with reference to FIGS. 3, 10-12B and 17-20B. Given that the two armrests of a single chair are typically identical, the present invention will be described with reference to only one of the two armrests. It should be understood that, in this embodiment, the other armrest is essentially identical to the described armrest.

The first armrest edge structure 10*c* will now be described with reference to FIGS. 3 and 11-12B. In this embodiment, the armrest edge structure 10*c* provides rigid support for loads applied by the suspension component 100*c*, while at the same time being relatively flexible when directly engaged by the occupant, such as when an occupant places weight directly onto the edge structure 10*c*. In this embodiment, armrest 214 generally includes a suspension component 100*c* joined to edge structure 10*c*. The suspension component 100*c* includes a load bearing fabric 102*c* that is joined to a carrier 104*c*, as discussed above in connection with seat 210. As with the seat 210, the armrest carrier 104*c* is configured to be mounted to the armrest edge structure 10*c* using pins 22*c* and recesses 24*c*, or other suitable attachment mechanisms, such as other mechanical features, fasteners or adhesives.

Referring now to FIG. 3, the edge structure 10*c* includes four generally liner sections joined in the corners to form a somewhat rectangular peripheral frame. More specifically, the edge structure 10*c* includes front section 12*c*, rear section 14*c*, left section 16*c* and right section 18*c*. In this embodiment, the section 12*c*, 14*c*, 16*c* and 18*c* are integrally molded to form the edge structure 10*c* as a single one-piece structure. In alternative embodiments, the sections may be separately manufactured.

In this embodiment, each section of the armrest edge structure 10*c* includes an inner rail 40*c*, an outer rail 42*c* and a plurality of beams 44*c* that extend in parallel arrangement between the inner rail 40*c* and the outer rail 42*c*. As perhaps best shown in FIG. 11, the beams 44*c* define a plurality of upwardly opening flex grooves, which in this embodiment are gaps 54*c*. The number, location, size, shape and configuration of the gaps 54*c* may vary. As an alternative to separate beams, the edge structure 10*c* may be formed by continuous material and the flex grooves may be upwardly opening channels that extend along the length of each section. In this embodiment, the carrier 104*c* includes a plurality of downwardly extending fingers 105 that are configured to substantially fill the gaps 54*c* in the beams 44*c*. The carrier 104*c* of this embodiment is manufactured from a resilient material, such as a polymer or elastomeric material. In the illustrated embodiment, the carrier 104*c* is manufactured from TPE, such as Dupont® Hytrel®. The carrier 104*c* may be manufactured from alternative materials as discussed above in connection with carrier 104. As a result of its material properties, the carrier 104*c* provides resilient resistance to upward bending of the beams 44*c*.

In use, the edge structure 10*c* has different moments of inertia when bent in opposite directions (e.g. upwardly and downwardly). In the embodiment shown in FIG. 12A, the carrier 104*c* is fitted to the edge structure 10*c* with fingers 105 fitted into each of the gaps 54*c* in the beams 44*c*. As the edge structure is bent upwardly, the gaps 54*c* increasingly closes on the finger 105 to progressively increase compress the resilient carrier material and progressively increase the resistance to further upward bending. However, when the main beam is bent in the opposite direction, the gaps 54*c* are free to open, thereby dramatically limiting the effective impact of the associated material as a tension member (See FIG. 12B). The result is that the edge structure 10*c* provides substantially greater resistance to upward bending than to downward bending.

The characteristics of the carrier material and the flex grooves may be varied to tune the response characteristics of the edge structure on a directional basis, a regional basis or between different edge structures. For example, more resilient carrier material may be used provide a support surface with greater resiliency. As another example, wider flex grooves and/or a larger number of flex grooves may be provided to increase resiliency. In the illustrated embodiment, each gap 54*c* is substantially filled by a corresponding finger 105. In alternative embodiments, the edge structure 10*c* may include one or more flex grooves that remain unfilled. Unfilled flex grooves may be implemented to assist in tuning the resiliency and the bending profile of the edge structure. The gaps 54*c* and fingers 105 need not correspond in width. For example, the gaps may be wider than the fingers to provide a lower initial moment of inertia that increases once the gaps close on the fingers. In such applications, the beams 44*c* can bend upwardly without resistance from the fingers until the gaps close on the carrier material. Once the gaps are closed, the carrier fingers and the associated beam material become compression members and the moment of inertia with respect to farther upward bending increases. In other alternative embodiments, the gaps and fingers may be shaped so that the fingers interlock with the gaps. For example, each finger may have a head and the corresponding gap may have a recess configured to receive the head.

Figure 11:
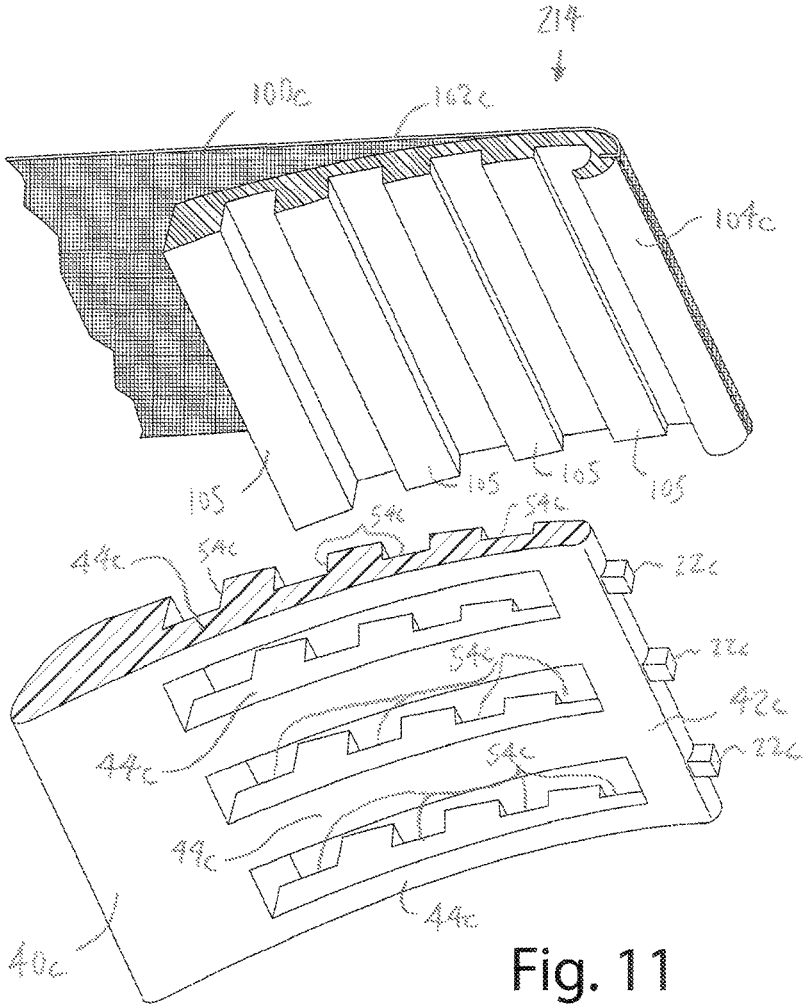
FIG. 11 is an exploded view of a portion of an alternative armrest.
Figure 12B:
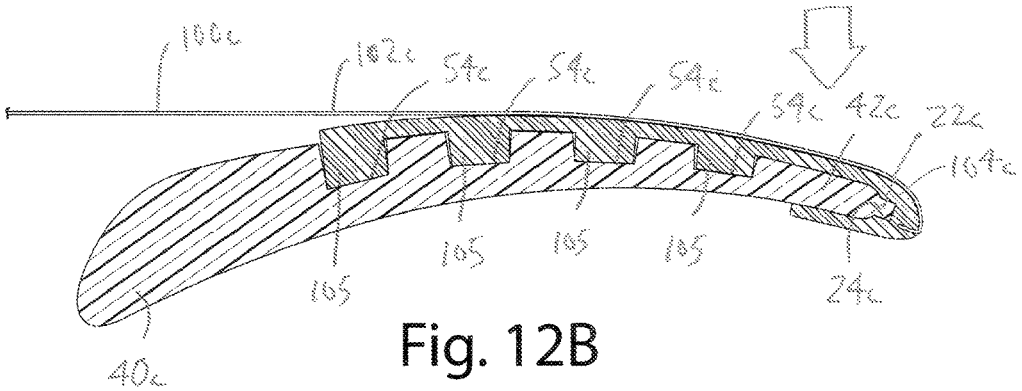
FIG. 12B is a cross section of the alternative armrest.

In the embodiment of FIG. 11-12B, the fingers 105 are integral with and extend from the carrier 104*c*. In alternative embodiments, the gaps 54*c* may be filled by resilient elements that are manufactured separately from the carrier 104*c*. For example, the carrier 104*c* may be fitted to the edge structure 10*c* in the manner shown in FIG. 8, and the gaps 54*c* may be filled by one or more separately manufactured resilient inserts (not shown).

It should be noted that the resilient fingers 105 can be used to provide the edge structure 10*c* with a resilient response to loads applied by the suspension component 100*c*. As a result, this approach may be used to provide a resilient, elastic body support surface without the use of a resilient, elastic suspension component. For example, the load bearing fabric 102*c* may be woven or otherwise formed from non-elastic materials and the resiliency can be provided by the resilient, elastic compression of the fingers 105 that occurs when the edge structure 10*c* bends upwardly.

An alternative armrest edge structure 10*c*' will now be described with reference to FIGS. 10 and 17-20B. The armrest edge structure 10*c*' provides rigid support for loads applied by the suspension component 100*c*', which includes tension in the suspension component 100*c*' and loads resulting from an occupant placing weight directly on the armrest suspension component 100*c*'. At the same time, the armrest edge structure 10*c*' is relatively flexible when directly engaged by the occupant, such as when an occupant places weight directly onto the edge structure 10*c*.

Figure 18:
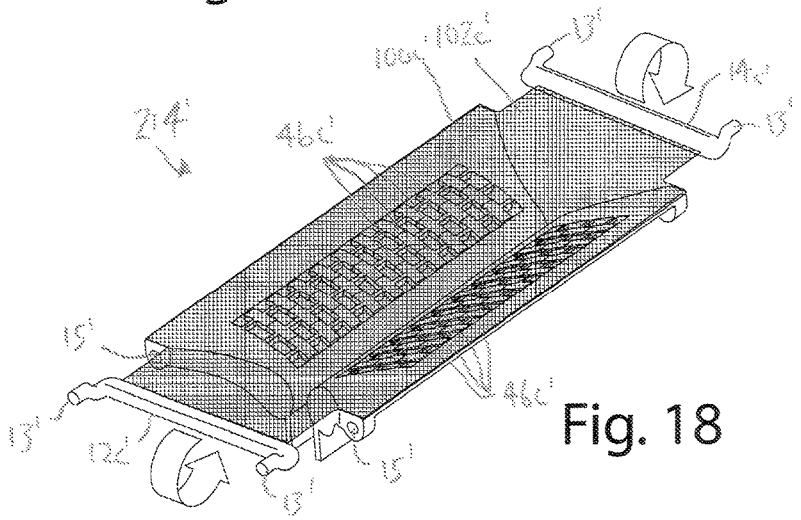
FIG. 18 is a perspective view of the suspension component of FIG. 17 illustrating assembly into an armrest.
Figure 19:
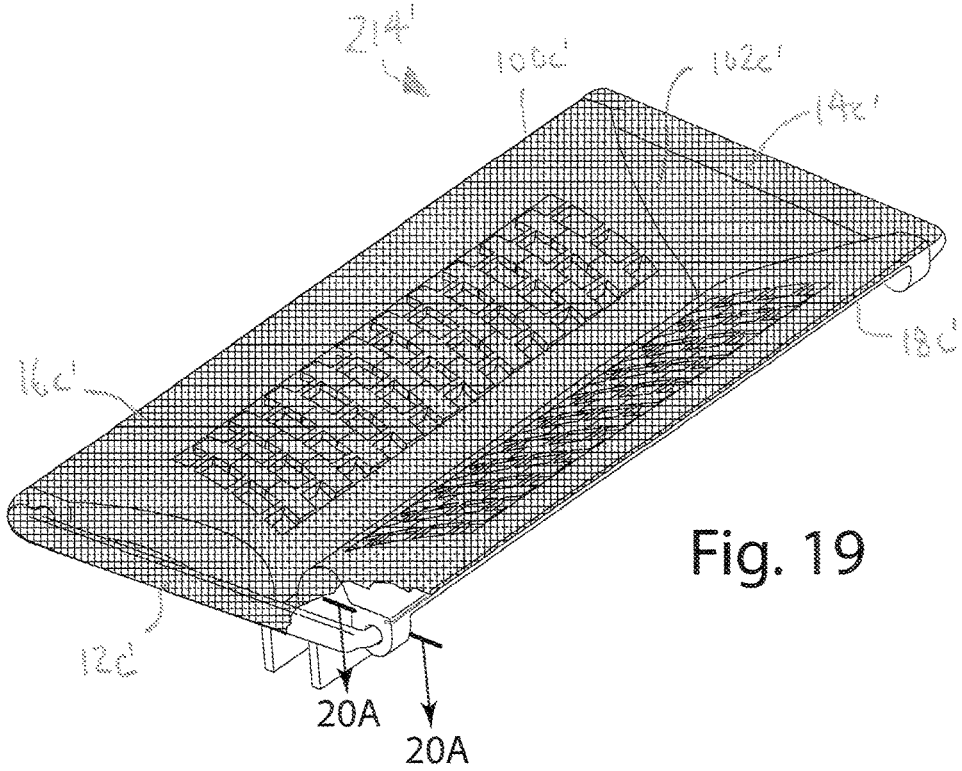
FIG. 19 is a perspective view of the assembled armrest with a portion of the suspension component removed.

In this embodiment, the armrest edge structure 10*c*' includes four sections that are joined together to form a peripheral frame (See FIG. 19). More specifically, the edge structure 10*c*' includes front section 12*c*', rear section 14*c*', left section 16*c*' and right section 18*c*'. In this embodiment, the left section 16*c*' and right section 18*c*' are generally similar to the left section 16 and right section 18 of the seat edge structure 10*a* in the sense that they include alternative main beams 44*c*' and segmented beams 46*c*'. Unlike the seat edges structure 10*a*, however, the front section 12*c*' and rear section 14*c*' of the armrest edge structure 10*c*' are generally rigid and do not include alternating beams. In alternative applications, the front section 12*c*' and rear section 14*c*' may be provided with alternating beams, if desired. In the embodiment shown in FIGS. 10 and 17-20B, the edge structure 10*c*' is molded directly onto the suspension component 102*c*' (e.g. load bearing fabric) and does not utilize a carrier to intersecured the suspension component 102*c*' and the edge structure 10*c*'. More specifically, edge structure 10*c*' includes separate front section 12*c*', rear section 14*c*', left section 16*c*' and right section 18*c*' that are molded directly onto load bearing fabric 102*c*' and are capable of being assembled into a peripheral arrangement. The four sections 12*c*', 14*c*', 16*c*' and 18*c*' are molded separately in the sense that they are not connected to one another in the molded state. The four sections 12*c*', 14*c*', 16*c*' and 18*c*' may be molded simultaneously or in separate molding operations, as desired.

Figure 20A:
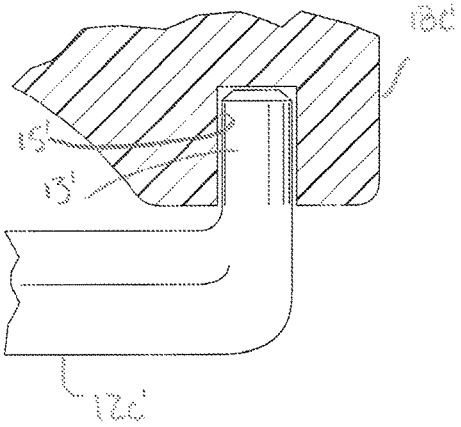
FIG. 20A is a sectional view of a portion of the assembled armrest showing the corner details.
Figure 20B:
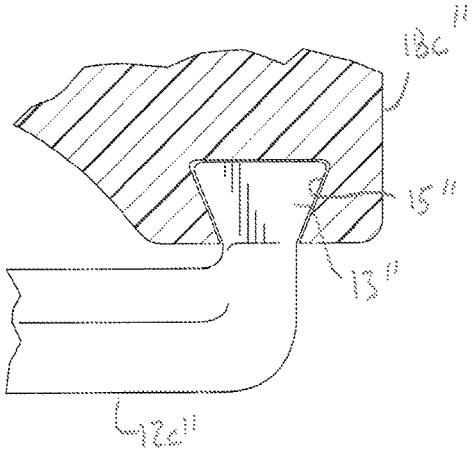
FIG. 20B is a sectional view of a portion of the assembled armrest showing an alternative corner detail.

In the illustrated embodiment, the four sections 12*c*', 14*c*', 16*c*' and 18*c*' are intended to be connected to one another at or near the corners. They may be connected at other locations, as desired. The connection structure may vary from application to application. However, in the illustrated embodiment, the connection structure includes mating pins 13' and recesses 15' that are fitted together during assembly to intersecure the four sections 12*c*', 14*c*', 16*c*' and 18*c*' into a peripheral frame. As can be seen, in this embodiment, pins 13' disposed at opposite ends of the front section 12*c*' and rear section 14*c*' are fitted into corresponding recesses 15' disposed at opposite ends of the front section 12*c*' and rear section 14*c*'. As perhaps best shown in FIGS. 17 and 18, the various sections 12*c*', 14*c*', 16*c*' and 18*c*' are molded to the load bearing fabric 102*c*' in an orientation that requires them to be rotated (e.g. folded down and under) to form the completed armrest 214'. FIG. 18 includes arrows illustrating how the front section 12*c*' and rear section 14*c*' can be rotated to allow the pins 13' to be fitted into the recesses 15'. As a result of this rotation, the load bearing fabric 102*c*' covers the exposed surfaces of the edge structure 10*c*' (See FIG. 19). In this embodiment, the rotation and assembly of sections 12*c*', 14*c*', 16*c*' and 18*c*' into a peripheral frame may also place the suspension component 100*c*' under tension. The amount of tension created by assembling the edge structure may vary from application to application, as desired. FIG. 19 is an illustration of the armrest 214' with a portion of the load bearing fabric 102*c*' removed to show one of the pins 13' fitted into one of the recesses 15' (See also FIG. 20A). The size, shape and configuration of the pins and recesses may vary from application to application. An alternative connection structure is shown in FIG. 20B. In this embodiment, the connection structure includes mating dovetail features disposed on opposite ends of each edge structure. More specifically, the connection structure may include a dovetail rail 13" extending from opposite ends of the front section 12*c*" and the rear section (not shown), and dovetail grooves 15" defined in opposite ends of the left section (not shown) and right section 18*c*". The dovetail features allow the sections to be slid together during assembly. The edge structure may rely solely on the mechanical connection provide by the connection structure to retain the edge structure sections in the assembled state. Alternatively, the connection structure may be supplemented or replaced by fasteners and/or adhesive.

In the embodiment illustrated in FIG. 19, the edge structure 10*c*' is configured to provide a flexible edge on the left and right sides of the armrest 214'. It should be understood that the present invention extends to include edge structures with any number of flexible edges, including edge structures without any flexible edges.

Figure 15:
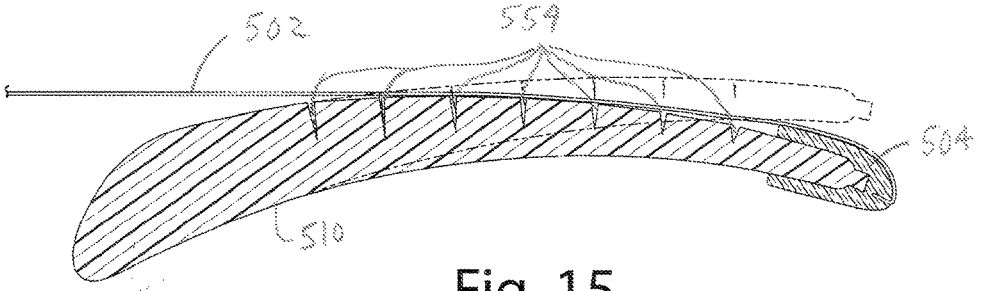
FIG. 15 is a sectional view of an alternative edge structure having slits.

As noted above, the present invention is generally directed to an edge structure that has a significantly greater moment of inertia in the direction associated with the load of the suspension component than in the opposite direction associated with direct occupant contact with the edge structure. The difference between the moments of inertia in opposite directions may vary from application to application, as appropriate. However, in the illustrate embodiment, the moment inertia relating to loads applied by the suspension component may be at least two times greater than the moment of inertia relating to direct loads in the opposite direction. In some applications, it may be desirable for the moments of inertia to vary by at least three times, at least five times, at least ten times, at least 20 times or at least 100 times. In select embodiments, this asymmetry in the moment of inertia results from segmented beams, which effectively function as compression members when a load is applied by the suspension component, but bend essentially freely when a load is applied directly to the edge structure in the opposite direction. The present invention may extend to other structures or methods capable of varying the moment of inertia. For example, as one alternative to a segmented beam, once side of the main beam may include one or more flex grooves, such as slit or gaps. An implementation of this embodiment is shown in FIG. 15. In the embodiment of FIG. 15, the edge structure 510 is joined to a load bearing fabric 502 by a carrier 504. In this embodiment, the edge structure 510 is tapered and includes a plurality of upwardly opening slits 554. When the edge structure 510 is bent upwardly, the slits 554 close and the associated material functions as a part of the compression member. However, when the edge structure 510 is bent downwardly, the slits 554 are free to open, thereby dramatically limiting the effective impact of the associated material as a tension member. The characteristics of the slits 554 (or flex grooves) may be varied to control the characteristics of the edge structure. For example, a larger number of flex grooves may further reduce the effective impact of the associated structure as a tension member. Further, the width of the flex grooves may be varied to control when the associated material functions as a compression member. For example, with wider flex grooves the main beam can bend farther before the gaps close and enhance the impact of the associated material as a compression member.

Figure 16A:
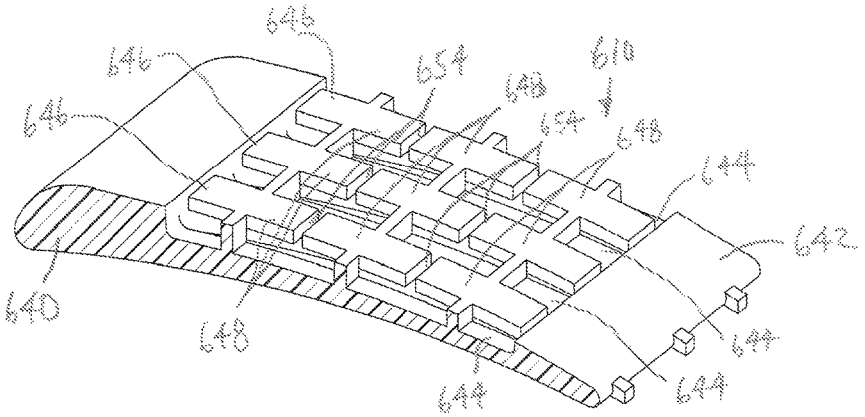
FIG. 16A is a perspective view of an alternative edge structure is its molded state.
Figure 16B:
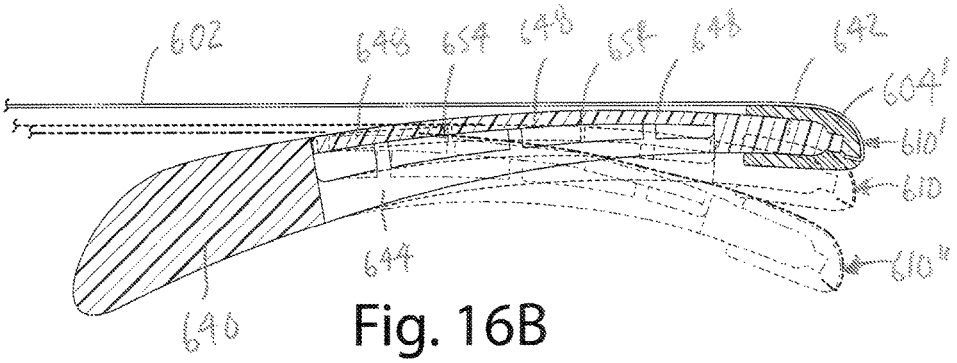
FIG. 16B is a sectional view of the alternative edge structure of FIG. 16A in different states.
Figure 17:
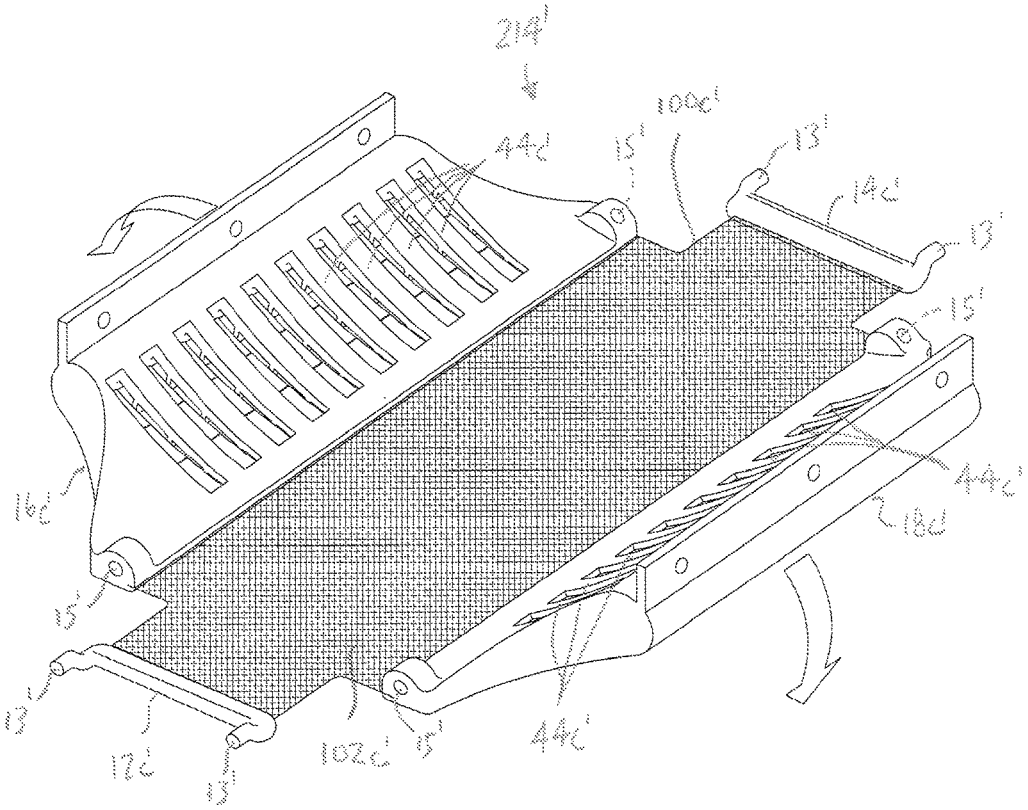
FIG. 17 is a perspective view of an alternative suspension component with integrally molded edge structure sections.

In some applications, it may be desirable to utilize gaps in the segmented beams to allow the edge structure 10*a* to be "pre-loaded" or to provide some initial flexibility in response to force applied by the load bearing fabric. This aspect of the present invention will be described with reference to FIGS. 16A and 16B, which show an edge structure 610 having an inner rail 640, an outer rail 642, a plurality of main beams 644 and a plurality of segmented beams 646. Suspension component 602 is secured to the edge structure 610 by carrier 604. The edge structure 610 is generally identical to edge structure 10*a*, except that it includes wider gaps 654 between adjacent segments 648. Operation of the edge structure 610 will now be described with reference to FIG. 16B. FIG. 16B shows the edge structure 610 in three different states. Edge structure 610 represents the edge structure 610 in its molded, relaxed state. When it is desirable to "pre-load" the edge structure 610, the tension in the suspension component 602 (e.g. load bearing fabric) may be used to bend the edge structure 610 upwardly and inwardly to close the gaps 654. Edge structure 610' represents the edge structure 610 after it has been bent upwardly and inwardly by the load in the suspension component 602. Edge structure 610" represents the edge structure 610 after it has been bent downwardly by a direct load (e.g. an occupant applying weight directly against the edge structure instead of the suspension component. When implemented in this way, the edge structure 610 will have a longer range of bending motion in response to direct loads because the edge structure 610 will be bending from an initial "pre-loaded" upwardly/inwardly position (edge structure 610') rather than from an initial neutral position (edge structure 610). The number, size, shape and configuration of the gaps 654 may be varied to control the bending profile of edge structure 610.

Figure 21:
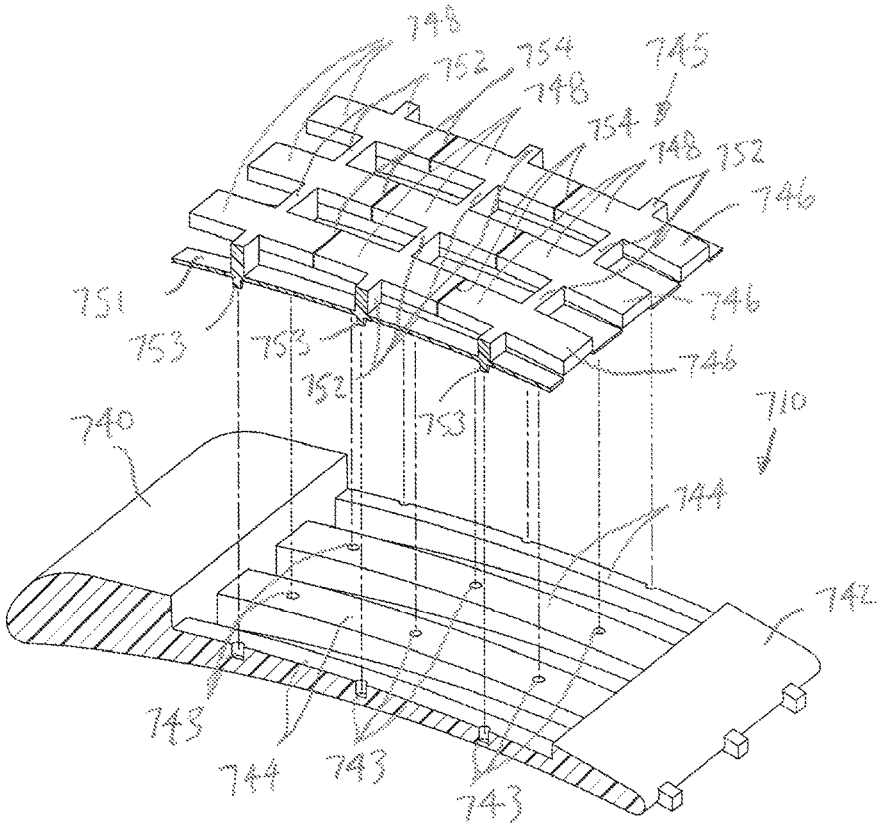
FIG. 21 is an exploded sectional view of an alternative edge structure assembled from two separately manufactured components.

In the embodiments discussed above, the segmented beams (e.g. segmented beam 46) are formed integrally with the edge structure. In alternative embodiments, the segmented beams may be manufactured separately from the remainder of the edge structure and secured to the edge structure during assembly. This may be particular helpful when it is desirable to manufacture the main beams and segmented beams from separate materials. FIG. 21 shows an alternative embodiment that is generally identical to the embodiment of FIG. 6A, except that the segmented beams are separately manufactured in a segmented beam layer 745. In this embodiment, the edge structure 710 generally includes an inner rail 740, an outer rail 742 and a plurality of main beams 744. The inner rail 740, outer rail 742 and main beams 744 are generally identical to those of edge structure 10*a* and therefor will not be described in detail. In this embodiment, the segmented beam layer 745 is secured to the edge structure 710 by an arrangement of pins and apertures. Accordingly, each main beam 744 defines a plurality of apertures 743 that open toward the segmented beam layer 745. The segmented beam layer 745 generally includes a plurality of main beam covers 751 and a plurality of segmented beams 746. In this embodiment, the main beam covers 51 are configured to overlay and be generally coextensive with the underlying main beams 744. The configuration of the main beam covers 51 may vary from application to application. In some applications, the main beam covers 51 may be eliminated. In this embodiment, the segmented beams 746 are arranged to extend over the gaps between adjacent main beams 744, but that is not necessary. As with edge structure 10*a*, each segmented beam 746 includes a plurality of beam segments 748 that are separated by gaps 754. Each beam segment 748 includes a beam section 750 that is joined to adjacent main beam covers 751 by connectors 752. A plurality of pins 753 extend from the segmented beam layer 745 toward the edge structure 710. The pins 753 are configured to be fitted into apertures 745 to secure the segmented beam layer 745 to the edge structure 710 through a friction fit. The number, size, shape and configuration of the pins 753 and apertures 743 may vary from application to application. For example, each pin may be provided with a head and each aperture may be shaped to closely receive the head. The head may be barb-shaped and may help to secure the pins 753 within the aperture 743.

Figure 22A:
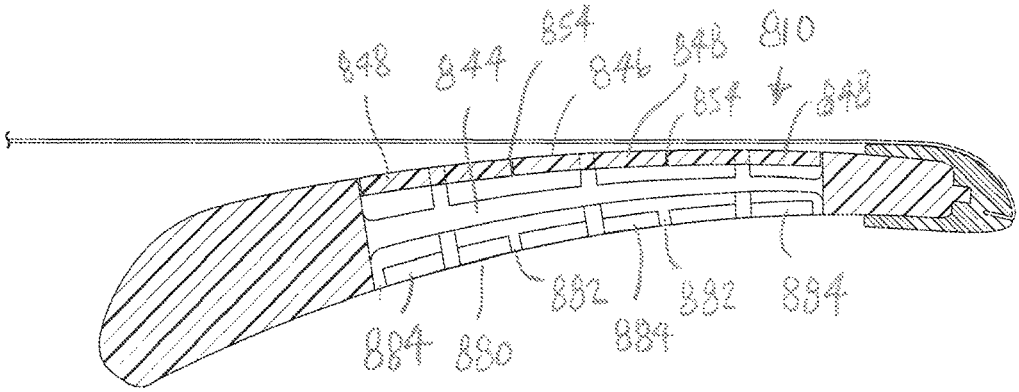
FIG. 22A is a sectional view of an alternative edge structure with two sets of segmented beams.
Figure 22B:
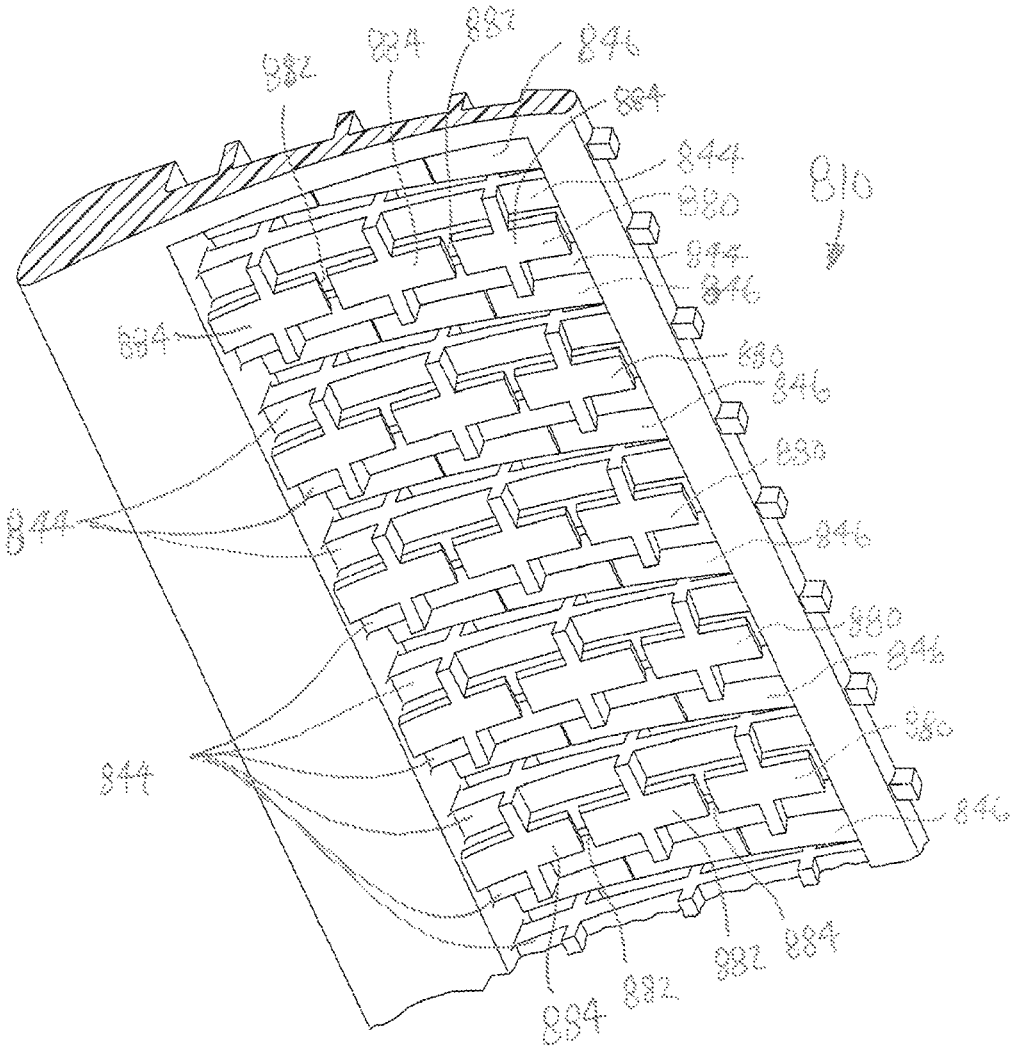
FIG. 22B is a bottom perspective view of the alternative edge structure of FIG. 22A.

In the embodiments discussed above, the edge structures include segmented beams disposed over the main beams to selectively reinforce the main beams against upward bending. In alternative embodiments, segmented beams may additionally be disposed below the main beams to selectively reinforce the main beams against downward bending. For example, in some applications it may be desirable to provide an edge that initially bends relatively easily in response to direct loads, but eventually provides greater resistance to further bending. An edge structure 810 having upper and lower segmented beams is shown in FIGS. 22A and 22B. In this embodiment, the main beams 844 and upper segmented beams 846 are essentially identical to those of the edge structure 10*a* shown in FIG. 8, and therefore will not be described in detail. Suffice it to say that each upper segmented beam 846 includes a plurality of beam segments 848 separately by gaps 854. In this embodiment, the lower segmented beams 880 are similar to the upper segmented beams 846, except that they include wider gaps 882 between adjacent segments 884. The wider gaps 882 between the segments 884 allow the main beams 844 to initially bend downwardly without material resistance from the lower segmented beams 880. However, once the gaps 882 have closed, the lower segmented beams 880 become compression members that resist further downward bending of the edge structure 810. In some applications, the lower segmented beams 880 may be substantial enough to prevent further downward bending in response to anticipated loads. In other applications, the lower segmented beams 880 may be configured to allow further downward bending. The gaps 882 can be configured not only to control when the lower segmented beam reinforces the main beam, but also the "final" shape of the edge structure. For example, the gaps may be larger toward the outer end of the beams to allow the outer portion of the edge structure 810 to bend farther than the inner portion of the edge structure 810. As perhaps best shown in FIG. 22B, the main beams 844, upper segmented beams 846 and lower segmented beams 880 alternate along the length of the edge structure 810.

Figure 23:
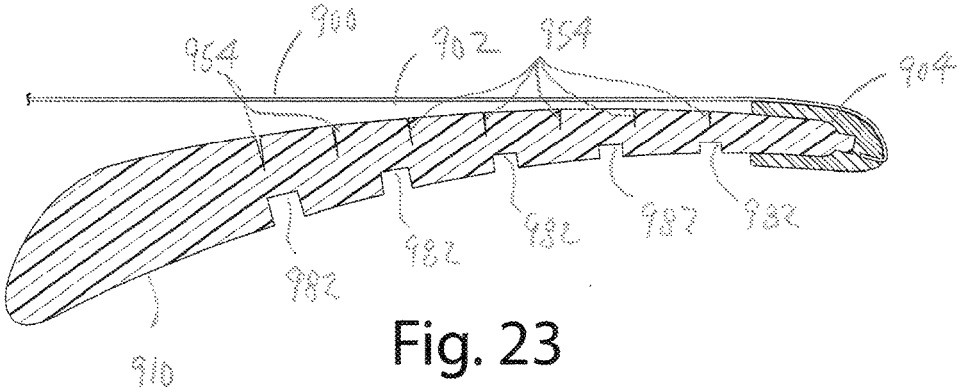
FIG. 23 is a sectional view of an alternative edge structure with top slits and bottom gaps.

FIG. 23 shows an alternative embodiment in which the edge structure includes flex grooves, such as slits and gaps, in opposite sides of the edge structure to provide the desired bending profile. In this embodiment, a suspension component 900 having a load bearing fabric 902 and a carrier 904 are joined to edge structure 910. The edge structure 910 of this embodiment is generally identical to edge structure 510 shown in FIG. 15, except that it include downwardly opening gaps that facilitate initial downward bending of the edge structure. The edge structure 910 includes a plurality of upwardly opening slits 954 that facilitate downward bending of the edge structure 910 in response to direct loads. As noted above, when the edge structure 910 is bent upwardly, the slits 954 will close and the associated material functions as a compression member. However, when the edge structure 910 is bent in the downwardly, the slits 954 are free to open, thereby dramatically limiting the effective impact of the associated material as a tension member. In this embodiment, the edge structure 910 also defines a plurality of downwardly opening gaps 982 that provide supplemental reinforcement against excessive downward bending. When the edge structure 910 is initially bent downwardly, the gaps 982 are open and the associated material plays a limited role as a compression member. However, as the edge structure 910 continues to bend downwardly, the gaps 982 eventually close and the associated material plays a more significant role in resisting further downward bending. The number, size, shape and configuration of the slits 954 and gaps 983 may be varied to tune the bending profile of the edge structure 910.

Figure 24:
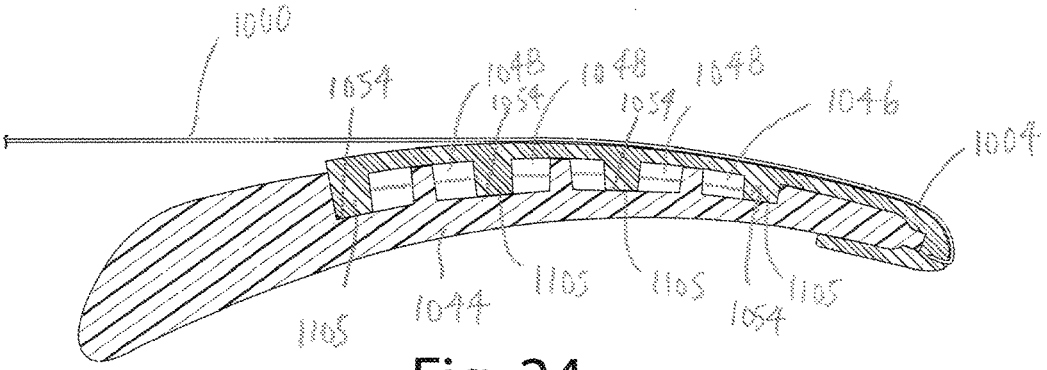
FIG. 24 is sectional view of an alternative edge structure in which a molded material is disposed in gaps in segmented beam.

Another alternative embodiment of the present invention in shown in FIG. 24. In this embodiment, the suspension component 1000 includes a carrier 1004 with fingers 1105 configured to be fitted into the gaps 1054 in the segmented beams 1046 of the edge structure 1010. The edge structure 1010 of this embodiment is generally identical to edge structure 610 shown in FIGS. 16A-B, except that the gaps 1054 are significantly wider to accommodate fingers 1105 extending downwardly from the carrier 1004. As a result, edge structure 1010 will not be described in detail. Suffice it to say that edge structure 1010 generally includes an inner rail 1040, an outer rail 1042, a plurality of main beams 1044 and a plurality of segmented beams 1046. The segmented beams 1046 include segments 1048 that are separate from one another and from the inner and outer rails 1040, 1042 by gaps 1054. As noted above, the carrier 1004 includes a plurality of downwardly extending fingers 1105 that generally fill the gaps 1054. As described above in connection with carrier 104*c*, the carrier 1004 may be manufactured from a resilient material so that fingers 1105 affect the upward bending profile of the edge structure 1010. The characteristics of the main beams 1044, segmented beams 1046, gaps 1054 and the material of the carrier 1004 may be varied to tune the bending profile of the edge structure 1010.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The embodiments of the invention in which an exclusive property or privilege is claimed are defined as follows:

1. A body support surface comprising:

a suspension component adapted to support an occupant and including a load-bearing fabric and a carrier attached thereto;

an edge structure secured to said carrier of said suspension component, said edge structure having a lateral extent extending between an inner edge and an outer edge, said edge structure being unsupported along a lower extent thereof such that said edge structure includes a cantilevered portion, said carrier of said suspension component extending around said cantilevered portion from beneath said lower extent of said edge structure to an upper portion thereof, said load-bearing fabric of said suspension component extending inwardly beyond said inner edge, said edge structure configured to bend along said lateral extent in a first direction in response to loads generated by said load-bearing fabric of said suspension component and a second direction opposed to said first direction in response to engagement of the occupant with said edge structure, and said edge structure including a main beam and a segmented beam, said main beam spaced apart from and extending generally parallel to said segmented beam, said main beam being generally continuous, said segmented beam being discontinuous and having a plurality of segments, said segments collectively forming a compression member when said edge structure bends in said first direction and capable of moving away from one another when said edge structure bends is said second direction, said edge structure having a resistance to bending in said first direction and a resistance to bending in said second direction, said main beam and said segmented beam cooperating such that said resistance to bending in said first direction is substantially greater than said resistance to bending in said second direction.

2. The body support surface of claim 1 wherein said resistance to bending in said first direction is at least two times greater than said resistance to bending in said second direction.

3. The body support surface of claim 1 wherein said resistance to bending in said first direction is at least five times greater than said resistance to bending in said second direction.

4. The body support surface of claim 1 wherein said resistance to bending in said first direction is at least ten times greater than said resistance to bending in said second direction.

5. The body support surface of claim 1 wherein said edge structure includes a plurality of said main beams and a plurality of said segmented beams, wherein said segment beams are disposed between said main beams and said load-bearing fabric of said suspension component, said segmented beams being configured to form a compression member when said edge structure bends in said first direction.

6. The body support surface of claim 5 wherein said edge structure includes a longitudinally extending inner rail and a longitudinally extending outer rail, said main beams extending laterally between said inner rail and said outer rail.

7. The body support surface of claim 6 wherein said segmented beams extend laterally between said inner rail and said outer rail.

8. The body support surface of claim 6 wherein each segmented beam includes a single segment joined to at least one of said inner rail and said outer rail, said segment extending laterally into engagement with the other of said inner rail and said outer rail.

9. The body support surface of claim 6 wherein each segmented beam includes a plurality of segments that are separately supported by said main beams.

10. The body support surface of claim 6 wherein each segmented beam includes a plurality of segments, each of said segments being supported on one side by one of said main beams and on an opposite side by another of said main beams.

11. The body support surface of claim 1 wherein said edge structure includes a plurality of main beams, a first plurality of segmented beams and a second plurality of segmented beams, wherein said first plurality of segmented beams and said second plurality of segmented beams are disposed on opposite sides of said main beams, said first plurality of segmented beams configured to form a compression member when said edge structure bends in said first direction, said second plurality of segmented beams configured to form a compression member when said edge structure bends in said second direction.

12. The body support surface of claim 1 wherein said edge structure includes a plurality of integrally molded sections, at least two of said sections being integrally joined at a corner, said edge structure defining a corner relief in said corner.

* * * * *